US007929894B2

(12) United States Patent
Murata et al.

(10) Patent No.: US 7,929,894 B2
(45) Date of Patent: Apr. 19, 2011

(54) DRIVING CONTROL DEVICE AND IMAGE FORMING APPARATUS INCLUDING THE SAME

(75) Inventors: Takuya Murata, Tokyo (JP); Kazuhiko Kobayashi, Tokyo (JP); Takuya Uehara, Tokyo (JP); Yuji Matsuda, Tokyo (JP); Yuichiro Ueda, Kanagawa (JP); Hiromichi Matsuda, Kanagawa (JP); Toshiyuki Andoh, Kanagawa (JP); Joh Ebara, Kanagawa (JP); Yohei Miura, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 188 days.

(21) Appl. No.: 12/314,514

(22) Filed: Dec. 11, 2008

(65) Prior Publication Data

US 2009/0169225 A1 Jul. 2, 2009

(30) Foreign Application Priority Data

Dec. 12, 2007 (JP) ..... 2007-320814

(51) Int. Cl.
*G03G 13/14* (2006.01)

(52) U.S. Cl. ..... 399/302; 399/297; 399/308; 399/121

(58) Field of Classification Search ..... 399/9, 46, 399/301, 302, 308
See application file for complete search history.

(56) References Cited

U.S. PATENT DOCUMENTS

| | | | | |
|---|---|---|---|---|
| 7,386,262 | B2 * | 6/2008 | Okamura et al. | 399/298 |
| 2003/0002887 | A1 * | 1/2003 | Imaizumi et al. | 399/167 |
| 2004/0086299 | A1 * | 5/2004 | Matsuda et al. | 399/167 |
| 2005/0085945 | A1 * | 4/2005 | Andoh et al. | 700/230 |
| 2006/0088338 | A1 * | 4/2006 | Matsuda et al. | 399/167 |
| 2006/0110189 | A1 * | 5/2006 | Matsuda et al. | 399/301 |
| 2006/0133861 | A1 * | 6/2006 | Sakai | 399/301 |
| 2008/0303202 | A1 * | 12/2008 | Noguchi et al. | 271/10.06 |
| 2009/0190972 | A1 * | 7/2009 | Ohkubo et al. | 399/301 |

FOREIGN PATENT DOCUMENTS

| | | |
|---|---|---|
| JP | 3186610 | 5/2001 |
| JP | 2001-228777 | 8/2001 |
| JP | 3658262 | 3/2005 |
| JP | 2005-115398 | 4/2005 |

OTHER PUBLICATIONS

English language Abstract JP 2000-310897 dated Nov. 7, 2000.
English language Abstract JP 10-078734 dated Mar. 24, 1998.

* cited by examiner

*Primary Examiner* — David P Porta
*Assistant Examiner* — Casey Bryant
(74) *Attorney, Agent, or Firm* — Harness, Dickey & Pierce, P.L.C.

(57) ABSTRACT

A driving control device for use in an image forming apparatus includes a control unit that analyzes any one of a speed variation pattern and a thickness variation pattern of an endless belt member of the image forming apparatus per at least one rotation of the endless belt member while endlessly moving the endless belt member by a driving rotating unit, and starts to execute, based on a result of analysis, a driving-speed-control-pattern updating process to update a driving speed control pattern of the driving rotating unit per at least one rotation of the endless belt member, after a power of an image forming apparatus is turned on and within a preparation period in which a predetermined preparation process is completed so that an image forming operation can be started based on an image formation command from an operator.

14 Claims, 11 Drawing Sheets

DRIVING CONTROL DEVICE AND IMAGE FORMING APPARATUS INCLUDING THE SAME

CROSS-REFERENCE TO RELATED APPLICATIONS

The present application claims priority to and incorporates by reference the entire contents of Japanese priority document 2007-320614 filed in Japan on Dec. 12, 2007.

BACKGROUND OF THE INVENTION

1. Field of the Invention

The present invention relates to a driving control device and an image forming apparatus that includes the driving control device.

2. Description of the Related Art

An image forming apparatus is known, in which toner images carried by a plurality of image carriers are transferred onto a surface of an endless belt that moves endlessly or onto a recording sheet that is held on the endless belt in a superimposed manner. Such an image forming apparatus is disclosed in, for example, Japanese Patent No. 3658262. The image forming apparatus includes a transfer unit in which a belt member in the form of an endless intermediate transfer belt moves endlessly while being supported by a driving roller and a driven roller. The transfer unit transfers toner images of different colors that are formed on a plurality of photosensitive elements as image carriers onto the intermediate transfer belt in a superimposed manner, thereby obtaining a full color image. An image forming apparatus that uses a direct transfer method is also disclosed in Japanese Patent No. 3658262. In the direct transfer method, instead of an intermediate transfer method that uses the intermediate transfer belt, the toner images on the photosensitive elements are superimposed and transferred onto a recording sheet held on a surface of an endless sheet-transporting belt. The above methods to transfer toner images formed on the respective image carriers onto the surface of the belt member or onto the recording sheet on the belt member in a superimposed manner is called the tandem method.

In the image forming apparatus that uses the tandem method, toner images are superimposed, but are often displaced with each other due to a speed variation of the belt member. At the time of superimposing transfer, if a speed variation occurs in the belt member, the toner images on the image carriers are transferred at mutually displaced positions. Uneven thickness of the belt member in a circumferential direction is likely to result in the speed variation of the belt member. If a portion of the belt member having comparatively greater belt thickness is wound on the driving roller that drives the belt member, a belt moving speed increases. If a portion of the belt member having comparatively smaller belt thickness is wound on the driving roller, the belt moving speed decreases. Due to this, a speed variation occurs during a single rotation of the belt member. In the belt member that is manufactured using a centrifugal casting method, decentering of a metal mold for casting the belt results in occurrence of uneven thickness such that a phase lag of 180 degrees occurs between maximum thickness portions and minimum thickness portions in a single belt rotation. In the uneven thickness mentioned earlier, a characteristic of the speed variation per single belt rotation is a sine curve of one cycle.

The image forming apparatus disclosed in Japanese Patent No. 3658262 uses the belt member in which predetermined positions in the circumferential direction are marked and a mark sensor detects the marks at predetermined endless movement positions of the belt member. Furthermore, based on the marks, a belt thickness variation pattern of one rotation in the circumferential direction is prior stored, and based on a mark detection timing and the belt thickness variation pattern, a driving speed of the belt member is adjusted to curb the speed variation of the belt member due to uneven thickness.

An image forming apparatus disclosed in Japanese Patent Application Laid-open No. 2001-228777 includes a thickness detector that detects a thickness of the belt member based on a distance displacement of the belt member from the sensors and an electrical resistance. The thickness detector detects the thickness of the belt member while causing the belt member to move endlessly. After storing the belt thickness variation pattern in a belt circumferential direction based on the result of the detection in a data storing unit, the driving speed of the belt member is adjusted, thus curbing the speed variation due to uneven thickness of the belt member.

An image forming apparatus disclosed in Japanese Patent Application Laid-open No. 2005-115398 includes an encoder that detects a rotation angular displacement or a angular velocity of support rollers by which the belt member is supported. Based on a result of the detection, the speed variation pattern per one rotation of the belt member is measured. Next, based on the speed variation pattern that is stored in a data storage unit, the driving speed of the belt member is adjusted. Thus, speed variation due to uneven thickness of the belt member is curbed.

The thickness of the belt member changes due to expansion and contraction of the belt member resulting from environmental changes such as temperature and humidity, and belt elongation, belt wear, and tear due to passage of time. The thickness variation pattern per one rotation of the belt member changes due to a change in the thickness of the belt member. However, in the image forming apparatus disclosed in Japanese Patent No. 3658262, the change in the thickness variation pattern cannot be reflected in the adjustment of the driving speed of the belt member. However, in the image forming apparatuses disclosed in Japanese Patent Application Laid-open No. 2001-228777 and 2005-115398, even if the thickness of the belt member changes due to environmental change, the change in the thickness can be reflected in the adjustment of the driving speed of the belt member in the following manner. That is, the thickness variation pattern and the speed variation pattern (hereinafter, collectively called "variation pattern") are measured and updated at each predetermined timing. Thus, the speed variation due to uneven thickness of the belt member can be reliably curbed.

However, in the image forming apparatuses disclosed in Japanese Patent Application Laid-open No. 2001-228777 and 2005-115398, depending on the timing to measure the variation pattern, an image formation command from a user cannot be received until measurement of the variation pattern is completed. Due to this, a waiting time period of the user increases, thus causing inconvenience to the user.

SUMMARY OF THE INVENTION

It is an object of the present invention to at least partially solve the problems in the conventional technology.

According to an aspect of the present invention, there is provided a driving control device for use in an image forming apparatus that includes a plurality of image carriers on which toner images are formed, respectively, and a transfer unit that includes an endless belt member and a plurality of rotating units that supports the endless belt member and at least one of which is a driving rotating unit driven to rotate to move the endless belt member endlessly so that the toner images on the image carriers are transferred onto a surface of the endless belt member or a recording medium that is held on the surface, the driving control device including: a control unit that analyzes any one of a speed variation pattern and a thickness variation pattern of the endless belt member per at least one rotation of the endless belt member while endlessly moving the endless belt member, and starts to execute, based on a result of analysis, a driving-speed-control-pattern updating process to update a driving speed control pattern of the driving rotating unit per at least one rotation of the endless belt member, after a power of the image forming apparatus is turned on and within a preparation period in which a predetermined preparation process is completed so that an image forming operation can be started based on an image formation command from an operator.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is a timing chart of an example of execution timings of various processes in a post-power-on preparation process that is executed immediately after a power of the printer has been turned on;

FIG. 13 is a flowchart of a control process that is executed by a controller immediately after the power has been turned on.

DETAILED DESCRIPTION OF THE PREFERRED EMBODIMENTS

Exemplary embodiments of the present invention are explained in detail below with reference to the accompanying drawings.

In the following embodiment, the present invention is employed to an electrophotographic printer (hereinafter, simply "printer") as an image forming apparatus as an example.

Figure 1:
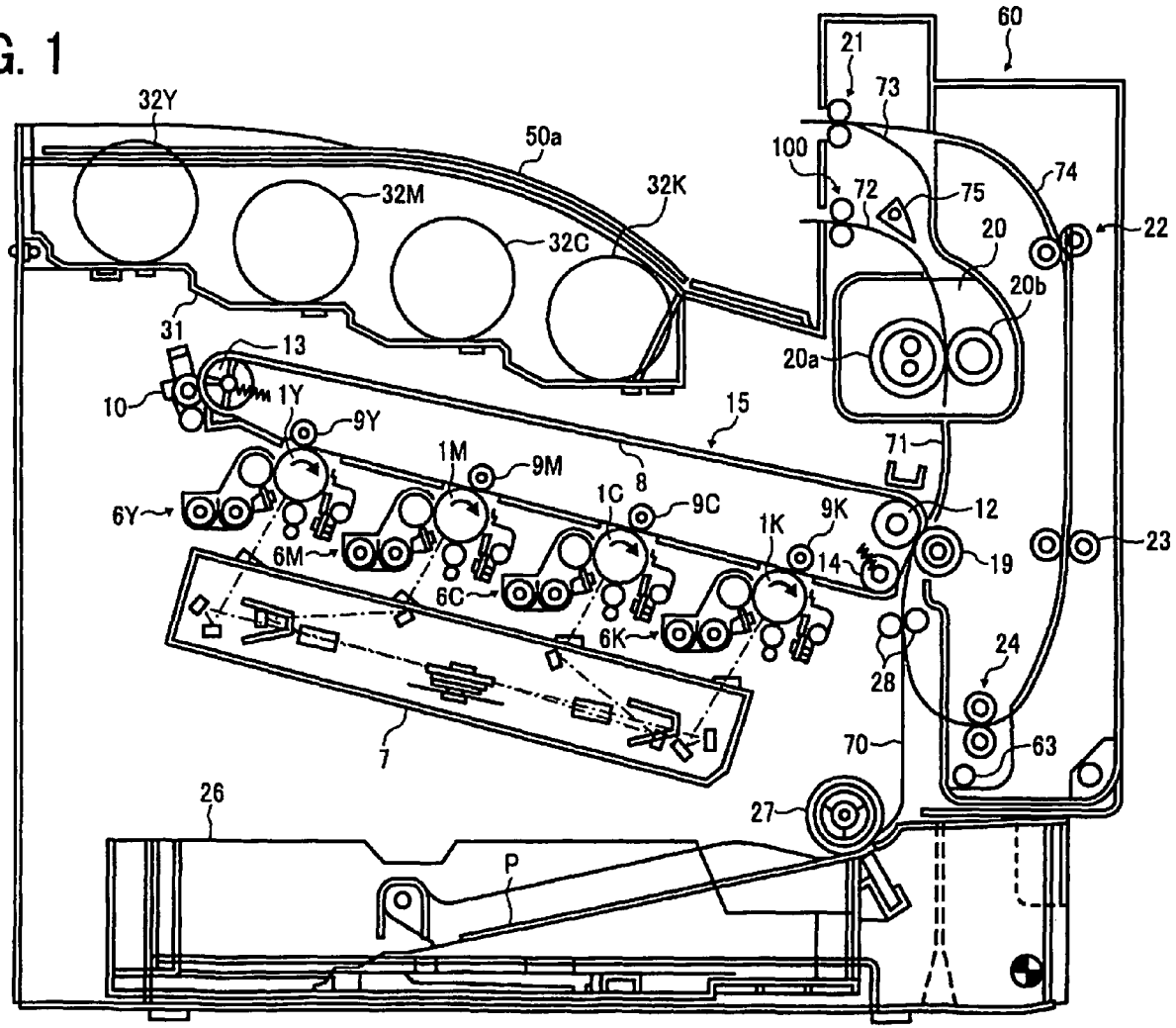
FIG. 1 is a schematic diagram of a printer according to an embodiment of the present invention.
Figure 2:
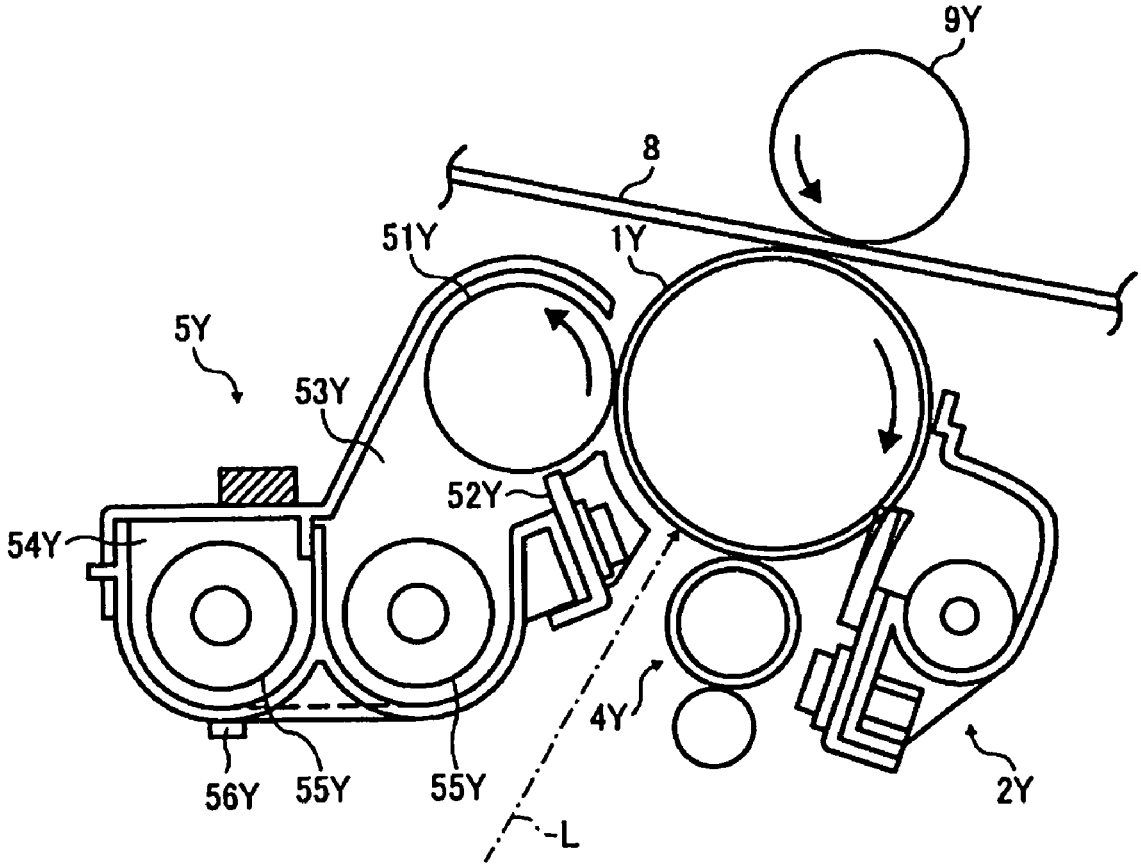
FIG. 2 is a schematic diagram of a Y processing unit and of its periphery of the printer shown in FIG. 1.

A basic structure of the printer according to the present embodiment of the present invention is explained first. FIG. 1 is a schematic diagram of the printer according to the embodiment. As shown in FIG. 1, the printer includes processing units 6Y, 6M, 6C, and 6K as image forming units that generate toner images of yellow (Y), magenta (M), cyan (C), and black (K) colors respectively. The processing units 6Y, 6M, 6C, and 6K, which use mutually different Y, M, C, and K toners respectively as an image forming material, have a similar structure. The processing units 6Y, 6M, 6C, and 6K are replaced upon reaching their lifetime. The structure of the processing unit 6Y that generates a Y toner image is explained as an example. As shown in FIG. 2, the processing unit 6Y includes a drum-shaped photosensitive element 1Y as a latent image carrier, a photosensitive-element cleaning unit 2Y, a neutralizing unit (not shown), a charging unit 4Y, and a developing unit 5Y. The processing unit 6Y is detachable from a main body of the printer. Worn out components of the processing unit 6Y can be replaced at one time.

The charging unit 4Y uniformly charges the surface of the photosensitive element 1Y that is rotated clockwise by a driving unit (not shown) in FIG. 2. The uniformly charged surface of the photosensitive element 1Y is exposed/scanned by a laser beam L, so that a Y electrostatic latent image is formed thereon. The Y electrostatic latent image is developed into the Y toner image by the developing unit 5Y that uses a Y developer containing a Y toner and a magnetic carrier. The Y toner image is intermediate transferred onto an intermediate transfer belt 8 as a belt member. The photosensitive-element cleaning unit 2Y removes the toner that remains on the surface of the photosensitive element 1Y after the intermediate transfer. The neutralizing unit neutralizes the surface of the photosensitive element 1Y after the cleaning. Due to the neutralization, the surface of the photosensitive element 1Y is initialized and becomes ready for subsequent image formation. M, C, and K toner images are formed on photosensitive elements 1M, 1C, and 1K of the remaining processing units 6M, 6C, and 6K, respectively, in the similar manner. The M, C, and K toner images are intermediate transferred onto the intermediate transfer belt 8.

The developing unit 5Y includes a developing roller 51Y that is arranged to be partially exposed from an opening of a casing of the developing roller 51Y. The developing unit 5Y further includes a pair of conveying screws 55Y that are arranged parallel to each other, a doctor blade 52Y, and a toner density sensor (hereinafter, "T sensor") 56Y.

The Y developer is contained in the casing of the developing unit 5Y. The Y developer is friction charged while being stirred and conveyed by the conveying screws 55Y and carried on the surface of the developing roller 51Y. The doctor blade 52Y regulates a layer thickness of the Y developer. Next, the Y developer is conveyed to a developing area opposite the Y photosensitive element 1Y and the Y toner is caused to adhere to the Y electrostatic latent image on the photosensitive element 1Y. Due to this, the Y toner image is formed on the photosensitive element 1Y. In the developing unit 5Y, along with the rotation of the developing roller 51Y, the Y developer in which the Y toner is consumed due to the developing is returned to the casing.

A dividing partition is arranged between the conveying screws 55Y, so that the casing is divided into a first supplying unit 53Y that houses the developing roller 51Y and the conveying screw 55Y on the right, and a second supplying unit 54Y that houses the conveying screw 55Y on the left in FIG. 2. The conveying screw 55Y on the right in FIG. 2 is driven to rotate by the driving unit (not shown) and supplies the Y developer inside the first supplying unit 53Y to the developing roller 51Y while conveying the Y developer from the front side towards the inner side in FIG. 2. The Y developer, which is conveyed by the conveying screw 55Y on the right to near an end portion of the first supplying unit 53Y, enters the second supplying unit 54Y via an opening (not shown) formed in the dividing partition. In the second supplying unit 54Y, the conveying screw 55Y on the left in FIG. 2 is driven to rotate by the driving unit and conveys the Y toner conveyed from the first supplying unit 53Y in a direction opposite to that in which the conveying screw 55Y on the right conveys the Y developer. The Y developer, which is conveyed by the conveying screw 55Y on the left to near an end portion of the second supplying unit 54Y in FIG. 2, returns to the first supplying unit 53Y via an opening (not shown) formed in the dividing partition.

The T sensor 56Y that includes a magnetic permeability sensor is arranged on a bottom wall of the second supplying unit 54Y. The T sensor 56Y outputs a voltage according to a magnetic permeability of the Y developer that passes above the T sensor 56Y. For ensuring a suitable correlation between the magnetic permeability of a two-component developer that contains the toner and the magnetic carrier, and the toner density, the T sensor 56Y outputs the voltage according to a Y toner density. The voltage output from the T sensor 56Y is transmitted to a controller (not shown). The controller includes a random access memory (RAM) that stores therein Y Vtref that is a target value of the voltage output from the T sensor 56Y. The RAM also stores therein data of M Vtref, C Vtref, and K Vtref that are target values of the respective voltages output from T sensors 56M, 56C, and 56K that are mounted on the other developing units 5M, 5C, and 5K. The Y Vtref is used in driving control of a Y toner-conveying device (not shown). Specifically, the controller controls driving of the Y toner-conveying device to replenish the Y toner inside the second supplying unit 54Y such that the voltage output from the T sensor 56Y is close to the Y Vtref. Due to replenishing, the Y toner density in the Y developer inside the developing unit 5Y is maintained within a predetermined range. A similar toner replenishment control is performed in the developing units 5M, 5C, and 5K of the other processing units 6M, 6C, and 6K by using M, C, and K toner-conveying devices.

As shown in FIG. 1, an optical writing unit 7, which is a latent image writer, is arranged under the processing units 6Y, 6M, 6C, and 6K. The optical writing unit 7 emits the laser beam L based on image data and radiates it to the photosensitive elements 1Y, 1M, 1C, and 1K in the processing units 6Y, 6M, 6C, and 6K, thus exposing the photosensitive elements 1Y, 1M, 1C, and 1K to the laser beam L. Due to the exposure, the Y, M, C, and K electrostatic latent images are formed on the photosensitive elements 1Y, 1M, 1C, and 1K respectively. The optical writing unit 7 emits the laser beam L from an optical source to the photosensitive elements via a plurality of optical lenses and mirrors while scanning by a polygon mirror that is driven to rotate by a motor.

A sheet storage unit is arranged under the optical writing unit 7. The sheet storage unit includes a sheet feeding cassette 26 and a sheet feeding roller 27 that is embedded into the sheet feeding cassette 26. The sheet feeding cassette 26 stores therein a plurality of overlapped recording sheets P that are sheet shaped recording media. The sheet feeding roller 27 is in contact with the topmost recording sheet P. Upon counterclockwise rotation of the sheet feeding roller 27 by a driver (not shown) in FIG. 1, the topmost recording sheet P is fed towards a sheet feeding path 70.

A pair of registration rollers 28 is arranged near an end of the sheet feeding path 70. The registration rollers 28 rotate to nip the recording sheet P therebetween, and temporarily stop rotating immediately after nipping the recording sheet P. Next, the registration rollers 28 convey the recording sheet P at an appropriate timing towards a secondary transfer nip that is explained below.

A transfer unit 15 is arranged above the processing units 6Y, 6M, 6C, and 6K. The transfer unit 15 includes the intermediate transfer belt 8, which is an endlessly moving member, a secondary-transfer bias roller 19, a belt cleaning unit 10, primary-transfer bias rollers 9Y, 9M, 9C, and 9K, a driving roller 12, a cleaning backup roller 13, and an encoder roller 14. The intermediate transfer belt 8 is support by the driving roller 12, the cleaning backup roller 13, and the encoder roller 14 that are arranged on the inner side of a belt loop. Rotatable driving of the driving roller 12 causes the intermediate transfer belt 8 to move endlessly counterclockwise in FIG. 1. The primary-transfer bias rollers 9Y, 9M, 9C, and 9K nip the endlessly moving intermediate transfer belt 8 with the photosensitive elements 1Y, 1M, 1C, and 1K, thereby forming respective primary transfer nips. The primary-transfer bias rollers 9Y, 9M, 9C, and 9K apply to a back surface (inner peripheral surface) of the intermediate transfer belt 8, a transfer bias having a polarity opposite to that of the toner. All the rollers apart from the primary-transfer bias rollers 9Y, 9M, 9C, and 9K are electrically earthed.

When moving endlessly, the intermediate transfer belt 8 sequentially passes the Y, M, C, and K primary transfer nips. Due to this, the Y, M, C, and K toner images on the respective photosensitive elements 1Y, 1M, 1C, and 1K are primary transferred onto the intermediate transfer belt 8 in a superimposed manner. Thus, a four-color superimposed toner image (hereinafter, "four-color toner image") is formed on the intermediate transfer belt 8.

The driving roller 12 nips the intermediate transfer belt 8 with the secondary-transfer bias roller 19, thereby forming the secondary transfer nip. The four-color toner image formed on the intermediate transfer belt 8 is transferred onto the recording sheet P in the secondary transfer nip, whereby a full-color image is formed in combination with a white color of the recoding sheet P. Toner that is not transferred onto the recording sheet P adheres to the front surface of the intermediate transfer belt 8 that has passed the secondary transfer nip. The residual toner is cleaned by the belt cleaning unit 10 that is a cleaning unit. The recording sheet P onto which the four-color toner image is collectively secondary transferred at the secondary transfer nip is conveyed to a fixing unit 20 via a post-transfer conveying path 71.

The fixing unit 20 forms a fixing nip by a fixing roller 20*a* and a pressing roller 20*b*. The fixing roller 20*a* includes a fixing heater that internally includes a heat source such as a halogen lamp. The pressing roller 20*b* rotates while being in contact with the fixing roller 20*a* at a predetermined pressure. The recording sheet P is conveyed into the fixing unit 20 so that the surface thereof on which the four-color toner image is formed is closely in contact with the fixing roller 20*a* to be nipped in the fixing nip. The toner in the four-color toner image melts due to heat and pressure and the full color image is fixed onto the recording sheet P. The fixing unit 20 includes a surface temperature sensor (not shown) that detects a temperature of the surface of the fixing roller 20*a*. A result of the detection by the surface temperature sensor is transmitted to the controller that is explained later.

After exiting the fixing unit 20, the recording sheet P to which the full color image is fixed in the fixing unit 20 enters a branching point of a sheet discharging path 72 and a pre-reversion conveying path 73. A first switching pawl 75 is swingably arranged at the branching point. Swinging of the first switching pawl 75 switches a path of the recording sheet P. Specifically, by bringing a tip of the first switching pawl 75 near the pre-reversion conveying path 73, the path of the recording sheet P is directed towards the sheet discharging path 72. Furthermore, moving the tip of the first switching pawl 75 away from the pre-reversion conveying path 73, the path of the recording sheet P is directed towards the pre-reversion conveying path 73.

If the first switching pawl 75 selects the path towards the sheet discharging path 72, after passing via a pair of sheet discharging rollers 100 from the sheet discharging path 72, the recording sheet P is stacked on a stacking unit 50*a* that is arranged outside the printer on an upper surface of a housing of the printer. If the first switching pawl 75 selects the path towards the pre-reversion conveying path 73, the recording sheet P passes via the pre-reversion conveying path 73 and enters a nip of a pair of reversing rollers 21. The reversing rollers 21 convey the recording sheet P towards the stacking unit 50*a*; however rotates reversely immediately before a rear end of the recording sheet P enters the nip. Due to reverse rotation, the recording sheet P is conveyed in an opposite direction and the rear end side of the recording sheet P enters a reverse conveying path 74.

The reverse conveying path 74 that extends while curving from an upper side towards a lower side in a vertical direction includes a pair of first reverse-conveying rollers 22, a pair of second reverse-conveying rollers 23, and a pair of third reverse-conveying rollers 24. The recording sheet P is conveyed while sequentially passing nips of the first reverse-conveying rollers 22, the second reverse-conveying rollers 23, and the third reverse-conveying rollers 24. Due to this, the recording sheet P is turned upside down. The recording sheet P that is turned upside down is returned to the sheet feeding path 70 and once again reaches the secondary transfer nip. The recording sheet P enters the secondary transfer nip while causing a non image-carrying surface thereof to be in contact with the intermediate transfer belt 8. A second four color-toner image on the intermediate transfer belt 8 is collectively secondary transferred onto the non image-carrying surface of the recording sheet P. Next, the recording sheet P passes the post-transfer conveying path 71, the fixing unit 20, the sheet discharging path 72, and the sheet discharging rollers 100, and is stacked on the stacking unit 50*a*. Thus, the full color image is formed on both the surfaces of the recording sheet P.

A bottle supporting unit 31 is arranged between the transfer unit 15 and the stacking unit 50*a* above the transfer unit 15. Toner bottles 32Y, 32M, 32C, and 32K, which are toner accommodating units that accommodate therein the Y, M, C, and K toners respectively, are mounted on the bottle supporting unit 31. The toner bottles 32Y, 32M, 32C, and 32K are arranged in a line to be slightly inclined with respect to the horizontal in FIG. 1. The toner bottles 32Y, 32M, 32C, and 32K are sequentially arranged at successively higher positions. The Y, M, C, and K toner inside the respective toner bottles 32Y, 32M, 32C, and 32K is appropriately supplied by respective toner-conveying devices to the respective developing units 5Y, 5M, 5C, and 5K. The toner bottles 32Y, 32M, 32C, and 32K are detachable from the main body of the printer separately from the processing units 6Y, 6M, 6C, and 6K.

Figure 3:
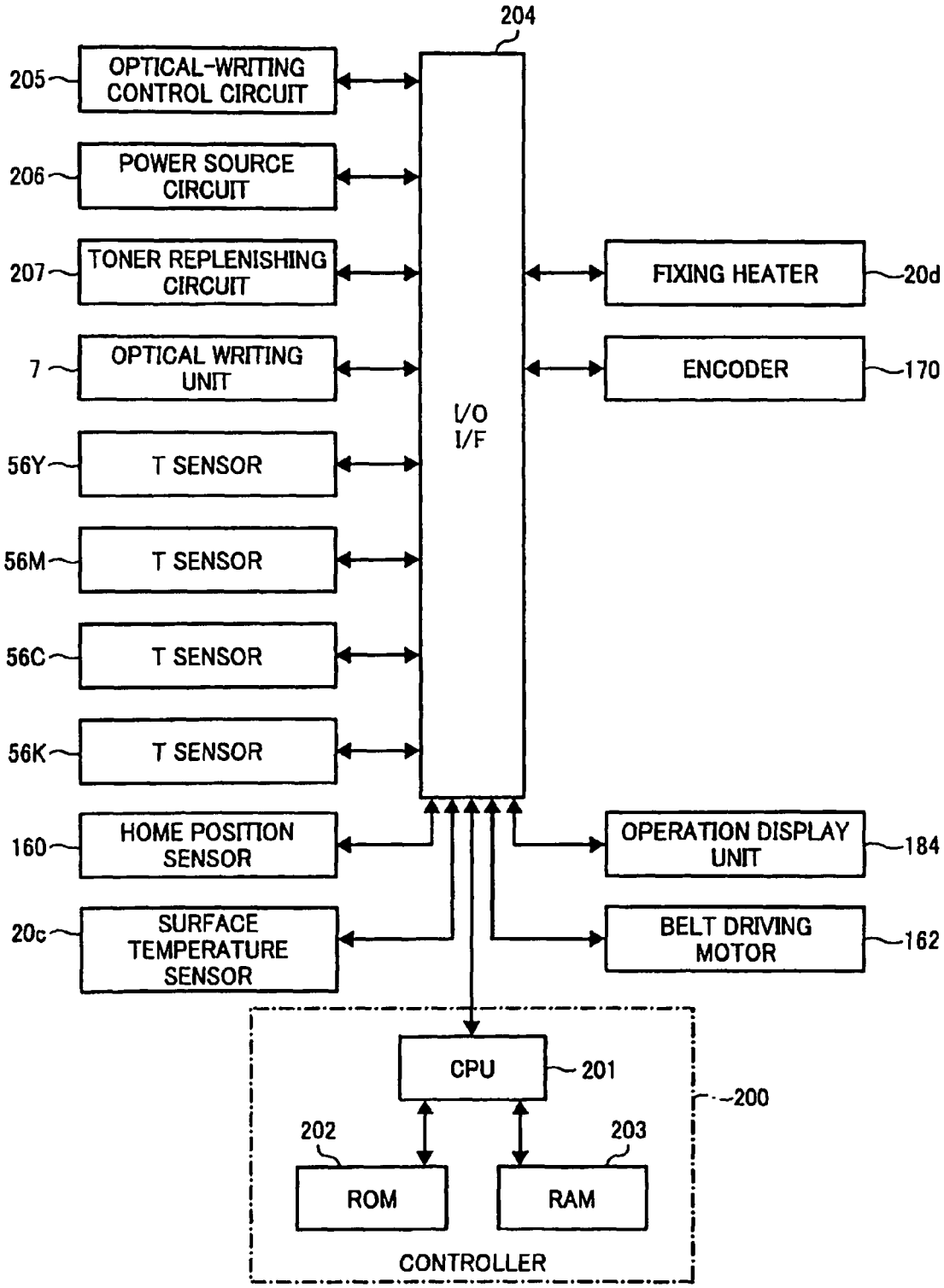
FIG. 3 is a block diagram of a portion of an electric circuit in the printer shown in FIG. 1.

FIG. 3 is a block diagram of a portion of an electric circuit in the printer according to the present embodiment. As shown in FIG. 3, a controller 200 as a calculating unit includes a central processing unit (CPU) 201, a random access memory (ROM) 202 that stores therein a control program and various types of data, and a RAM 203 that temporarily stores therein various types of data. The optical writing unit 7, the T sensors 56Y, 56M, 56C, and 56K, an optical-writing control circuit 205 that exclusively control the optical writing unit 7, a power source circuit 206, and a toner replenishing circuit 207 are connected to the controller 200 via an input output (I/O) interface (I/F) 204 for transmitting/receiving signals between the controller 200 and various peripheral controllers. Furthermore, a rotary encoder (hereinafter, simply "encoder") 170, a belt driving motor 162, a home position sensor 160, a surface temperature sensor 20*c* and a fixing heater 20*d* of the fixing unit 20, and an operation display unit 184 are also connected to the controller 200. The belt driving motor 162 is a driving source of the driving roller 12 that drives the intermediate transfer belt 8.

Based on a command that is input from the controller 200 via the I/O I/F 204, the optical-writing control circuit 205 controls the optical writing unit 7. Based on a command that is input from the controller 200 via the I/O I/F 204, the power source circuit 206 applies a high voltage to the charging units 4Y, 4M, 4C, and 4K and applies a developing bias to the developing rollers 51Y, 51M, 51C, and 51K.

Based on a command that is input from the controller 200 via the I/O I/F 204, the toner replenishing circuit 207 controls the toner-conveying devices (not shown) of respective colors. Due to this, toner replenishment from the toner bottles 32Y, 32M, 32C, and 32K (not shown) to the two-component developer inside the developing units 5Y, 5M, 5C, and 5K is controlled.

Based on output values from the T sensors 56Y, 56M, 56C, and 56K, the controller 200 outputs to the toner replenishing circuit 207 via the I/O I/F 204, a command to make the toner density of the two-component developer inside the developing units 5Y, 5M, 5C, and 5K reach a reference level.

Figure 4:
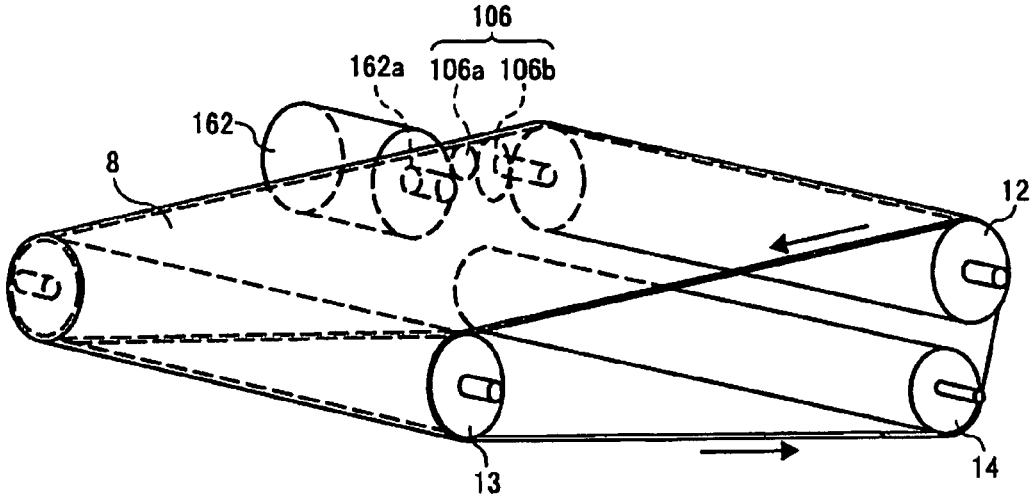
FIG. 4 is a schematic diagram of a belt unit that includes an intermediate transfer belt and rollers that support the intermediate transfer belt, in a transfer unit of the printer shown in FIG. 1.

FIG. 4 is a schematic diagram of a belt unit that includes the intermediate transfer belt 8, and the driving roller 12, the cleaning backup roller 13, and the encoder roller 14 that support the intermediate transfer belt 8 in the transfer unit 15. The intermediate transfer belt 8 is wound at a predetermined winding angle around each of the driving roller 12, the cleaning backup roller 13, and the encoder roller 14 that are arranged on the inner side of the belt loop. When the driving roller 12 is driven to rotate, the intermediate transfer belt 8 endlessly moves counterclockwise in FIG. 4. The cleaning backup roller 13 and the encoder roller 14 are driven to rotate along with the endless movement of the intermediate transfer belt 8. Therefore, a rotation angular displacement and a rotation angular velocity of the encoder roller 14 per unit time have a correlation with a running speed of the intermediate transfer belt 8. The encoder roller 14 includes an encoder (not shown).

A rotation driving force from the belt driving motor 162 as the driving source is transmitted to the driving roller 12 via a transmission mechanism 106 that includes a relay gear 106*a* and an input gear 106*b*. Specifically, the rotation driving force of an output shaft 162*a* of the belt driving motor 162 is transmitted to the relay gear 106*a* that meshes with an output gear that is fixed to the output shaft 162*a*. Then, the rotation driving force transmitted to the relay gear 106*a* is transmitted to the input gear 106*b* that meshes with the relay gear 106*a*. Because the input gear 106*b* is fixed to a rotating shaft of the driving roller 12, the rotation driving force is transmitted to the driving roller 12.

Figure 5:
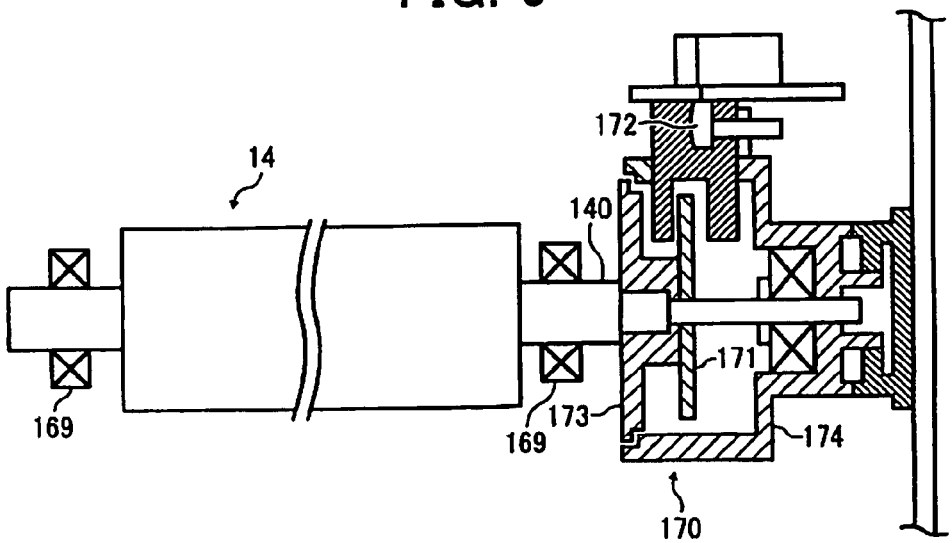
FIG. 5 is a schematic diagram of an encoder roller that is arranged inside a loop of the intermediate transfer belt, and an encoder that is arranged at one end of the encoder roller.

FIG. 5 is a schematic diagram of the encoder roller 14 and the encoder 170 that is arranged at one end of the encoder roller 14. As shown in FIG. 5, both ends of a rotating shaft 140 protrude from a roller portion of the encoder roller 14 in its axis direction, and one end of the rotating shaft 140 is tapered in three stages towards the outer side. The both ends of the rotating shaft 140 are rotatably supported by bearings 169 that are arranged on respective supporting plates of the transfer unit 15.

The encoder 170 that covers the one end of the rotating shaft 140 includes a disk-shaped code wheel 171, a transmission type photosensor 172, a supporting plate 173, and a cover 174. The code wheel 171 is fixed to the rotating shaft 140, so that the encoder 170 rotates together with the rotating shaft 140.

The supporting plate 173, which is formed of a resin material such as polyacetal resin, is press-fitted (lightly press fitted) into places on a base side of the rotating shaft 140. The code wheel 171 is fixed to an end surface (the end surface on the opposite side of a press-fitting direction) on one side of the supporting plate 173 with a double-faced tape (not shown). The bearing 169 also rotatably supports a tip of the rotating shaft 140, thus enhancing a positioning accuracy of the supporting plate 173 on which the code wheel 171 is fixed.

Figure 6:
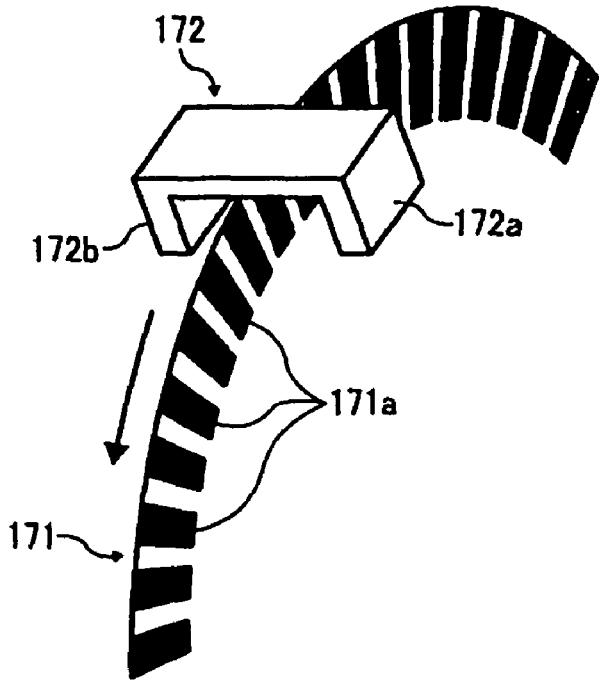
FIG. 6 is a schematic diagram of a code wheel and a transmission type photosensor of the encoder shown in FIG. 5.

The code wheel 171 is formed of polyethylene terephthalate (PET) having a thickness of approximately 0.2 millimeters. As shown in FIG. 6, radial slits 171*a* are formed in an outer edge of the code wheel 171. The slits 171*a* are formed, for example, by a pattern drawing technology using a photoresist.

Figure 7:
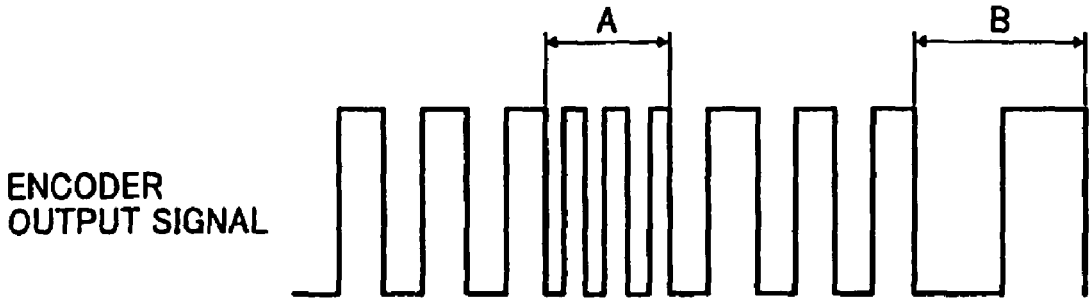
FIG. 7 is a pulse waveform diagram representing a characteristic of a voltage output from the transmission type photosensor shown in FIG. 6.

The transmission type photosensor 172 includes a light emitting element 172*a* and a light receiving element 172*b* that are positioned opposite to each other with a slit formed portion of the code wheel 171 therebetween. While the code wheel 171 is rotating, it is repeated in short cycles that the light transmission between the light emitting element 172*a* and the light receiving element 172*b* is interrupted by a non-slit-formed portion of the code wheel 171 and the light is transmitted between the light emitting element 172*a* and the light receiving element 172*b* through the slit 171*a*. More specifically, when the slit 171*a* (indicated by a black portion in FIG. 6) is positioned between the light emitting element 172*a* and the light receiving element 172*b*, the light emitted from the light emitting element 172*a* is received by the light receiving element 172*b*, and a voltage output from the transmission type photosensor 172 becomes high. When the slit 171*a* is not positioned between the light emitting element 172*a* and the light receiving element 172*b*, the light from the light emitting element 172*a* is interrupted by the non-slit-formed portion between the slits 171*a* and the voltage output from the transmission type photosensor becomes low. Accordingly, based on a frequency of encoder output signals shown in FIG. 7, the rotation angular velocity (hereinafter, simply "angular velocity") of the encoder roller 14 is determined by the controller 200. Although for the sake of convenience, the slits 171*a* are indicated by the black portions as shown in FIG. 6, actually, the slits 171*a* are narrow openings.

In a printer employing a tandem system such as that according to the embodiment, the intermediate transfer belt 8 needs to be moved at a constant speed. However, actually a variation occurs in a belt moving speed due to uneven thickness of the intermediate transfer belt 8 in a circumferential direction. Upon occurrence of variation in the belt moving speed of the intermediate transfer belt 8, an actual belt movement position is displaced from a target belt movement position. Due to this, tip positions of the respective toner images on the photosensitive elements 1Y, 1M, 1C, and 1K in a belt moving direction are displaced on the intermediate transfer belt 8, so that toner images of the respective colors are superimposed while being shifted with each other (color shift). The toner image portion that is transferred onto the intermediate transfer belt 8 when the belt moving speed is relatively faster expands in the belt moving direction compared with the original shape. The toner image portion that is transferred onto the intermediate transfer belt 8 when the belt moving speed is relatively slower contracts in the belt moving direction compared with the original shape. Due to this, a cyclic change in an image density (banding) appears in a direction corresponding to the belt circumferential direction in the final image that is formed on the recording sheet P.

To overcome the drawback, a driving-speed-control-pattern updating process is executed at a predetermined timing. In the driving-speed-control-pattern updating process, a speed variation pattern of the intermediate transfer belt 8 per at least one rotation is analyzed, and based on the result of the analysis, a driving speed control pattern per at least one rotation of the belt driving motor 162 is determined. Next, driving speed control pattern data in the RAM 203 is updated. During a print job, the belt driving motor 162 is driven based on the updated driving speed control pattern to stabilize the speed of the intermediate transfer belt 8.

Figure 8:
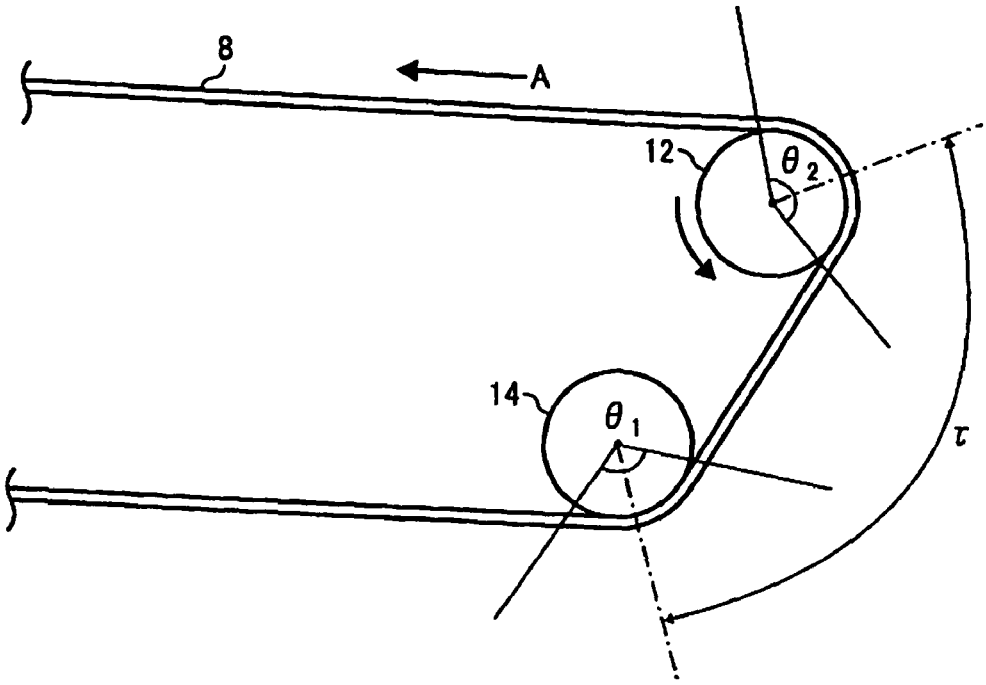
FIG. 8 is a schematic diagram of a peripheral portion of a secondary transfer nip in the intermediate transfer belt.

FIG. 8 is a schematic diagram of a peripheral portion of the secondary transfer nip in the intermediate transfer belt 8. The intermediate transfer belt 8 that is wound around the encoder roller 14 at a belt winding angle $\theta_1$ and wound around the driving roller 12 at a belt winding angle $\theta_2$ moves endlessly in a direction indicated by an arrow A in FIG. 8.

Based on signals transmitted from the encoder 170, the controller 200 recognizes a variation component that occurs in a rotation cycle of the intermediate transfer belt 8 and obtains an appropriate target value. The controller 200 performs sampling of the rotation angular displacement or the angular velocity of the driving roller 12 and the rotation angular displacement or the angular velocity of the encoder roller 14 as a method for determining the variation component. The rotation angular displacement or the angular velocity of the driving roller 12 can be determined based on signals from a motor encoder of the belt driving motor 162. Alternatively, the driving roller 12 can also include a motor encoder and the rotation angular displacement or the angular velocity of the driving roller 12 can be determined based on the signals from the motor encoder.

The controller 200 calculates amplitude and phase of the variation component that is calculated from a difference between the sampled rotation angular displacement or the angular velocity of the driving roller 12 and the rotation angular displacement or the angular velocity of the encoder roller 14. The amplitude and the phase of the variation component are determined as the speed variation pattern that occurs per one cycle of the intermediate transfer belt 8. Based on the speed variation pattern, the controller 200 determines the driving speed control pattern of the belt driving motor 162 such that a speed variation does not occur during one cycle of the intermediate transfer belt 8.

Figure 9:
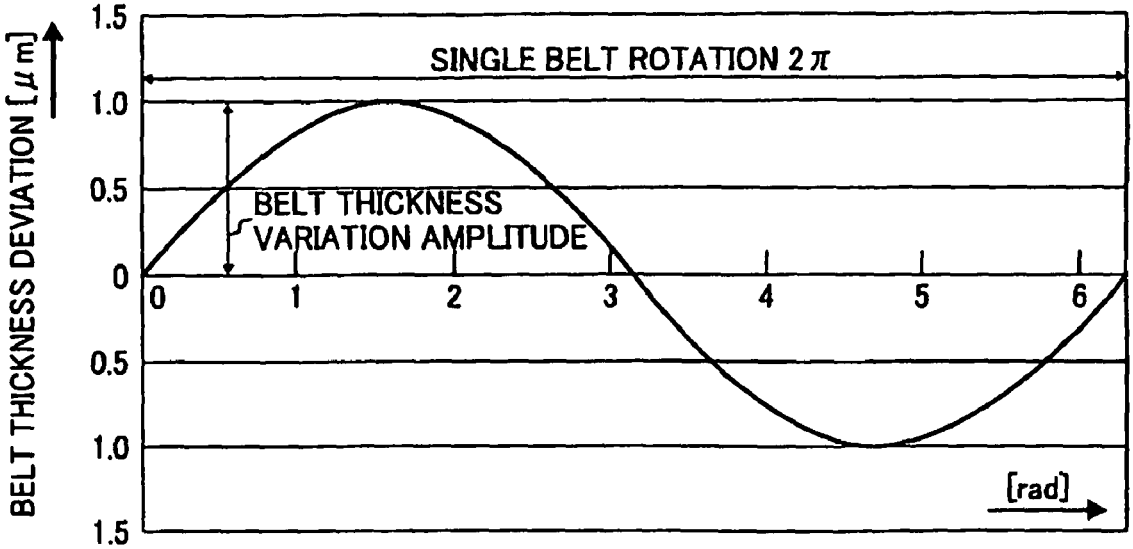
FIG. 9 is a graph of an example of a belt thickness variation in a circumferential direction of a belt.

FIG. 9 is a graph of an example of a belt thickness variation (a belt thickness deviation distribution) in the circumferential direction of a commonly used belt member. On a horizontal axis of the graph, a length of a single belt rotation (a belt perimeter) is substituted by an angle of $2\pi$ radian (rad). A vertical axis of the graph indicates a deviation value of a belt thickness when an average belt thickness (100 micrometers) in the belt circumferential direction is taken as a reference (reference value zero). In the belt thickness variation shown in FIG. 9, only a basic (primary) component (a component for which an occurrence cycle is equal to a single belt cycle) among frequency components of the belt thickness variation is indicated. However, in the present embodiment, controlling belt driving based on a thickness variation is applicable not only for such a primary component, but can also be applied to a high order component, as explained later.

The belt moving speed on the driving roller 12 side is calculated as follows. That is, a central portion of the intermediate transfer belt 8 on half of the belt winding angle $\theta_2$ of the driving roller 12 is temporarily set as a belt driving position X and the speed at the belt driving position X is assumed as the belt moving speed. When the thickness of the intermediate transfer belt 8 is sinusoidally changing along the circumferential direction (a sine wave), an effective belt thickness $B_t$ at the belt driving position X can be expressed by the following Equation (1):

$$B_t=B_{to}+B_{ta}\sin(\theta_b+\alpha) \quad (1)$$

where $B_{t0}$ indicates the average thickness of the intermediate transfer belt 8, $B_{ta}$ indicates amplitude of the thickness variation, $\theta_b$ indicates a belt thickness angular velocity, and $\alpha$ indicates an initial phase.

If a belt material is uniform and absolute values of a degree of expansion and contraction of an inner peripheral surface and an outer peripheral surface of the intermediate transfer belt 8 are nearly matching, the effective belt thickness $B_t$ is equivalent to a distance between a center of a belt thickness direction and a belt inner peripheral surface. In a belt having a multilayer structure, retractility differs between a hard layer and a soft layer. Due to this, the effective belt thickness $B_t$ can be a distance between a position that is displaced from the center of the belt thickness direction and the belt inner peripheral surface. Furthermore, the effective belt thickness $B_t$ also changes according to the belt winding angle $\theta_2$ with respect to the driving roller 12. Using an effective belt thickness coefficient $\kappa_d$, the effective belt thickness $B_t$ can be expressed by the following Equation (2). If the distance between the center of the belt thickness direction and the belt inner peripheral surface is equal to the effective belt thickness $B_t$, the effective belt thickness coefficient $\kappa_d$ becomes 0.5.

$$B_t'=(B_{to}+B_{ta}\sin(\theta_b+\alpha)\kappa_d \quad (2)$$

When the effective belt thickness is $B_t'$, a belt transport speed $V_b$ is calculated by ((driving roller radius $R_d$)+(effective belt thickness $B_t'$))×(driving roller angular velocity $\omega_d$), so that the belt transport speed $V_b$ can be expressed by the following Equation (3):

$$V_b=(R_d+\kappa_d B_{to}+\kappa_d B_{ta}\sin(\theta_b+\alpha))\omega_d \quad (3)$$

Thus, upon calculating the amplitude $B_{ta}$ of the thickness variation from Equation (3), it is clear that the belt transport speed at the belt driving position X changes.

The belt moving speed on the encoder roller 14 side is calculated as follows. A central portion of the intermediate transfer belt 8 on half of the belt winding angle $\theta_1$ of the encoder roller 14 is temporarily set as a belt driven position Y and the speed at the belt driven position Y is assumed as the belt driving speed. If the length of the single belt rotation is $2\pi$ radian, a distance from the belt driving position X to the belt driven position Y can be expressed as a phase difference $\tau$ radian. Thus, an effective belt thickness $B_t''$ at the belt driven position Y can be expressed by the following Equation (4):

$$B_t''=(B_{to}+B_{ta}\sin(\theta_b+\alpha+\tau))\kappa_e \quad (4)$$

where $\kappa_e$ indicates an effective belt thickness coefficient on the encoder roller 14 side. Because belt winding amounts at the driving roller 12 and the encoder roller 14 are likely to be different, a separate effective belt thickness coefficient is set. Thus, when the belt having the effective belt thickness $B_t''$ is wound, the belt transport speed $V_b$ at the belt driven position Y can be expressed by the following Equation (5):

$$V_b=(R_e+\kappa_e B_{to}+\kappa_e B_{ta}\sin(\theta_b+\alpha+\tau))\omega_e \quad (5)$$

where $R_e$ indicates a driven roller radius and $\omega_e$ indicates a driven roller angular velocity.

Figure 10A:
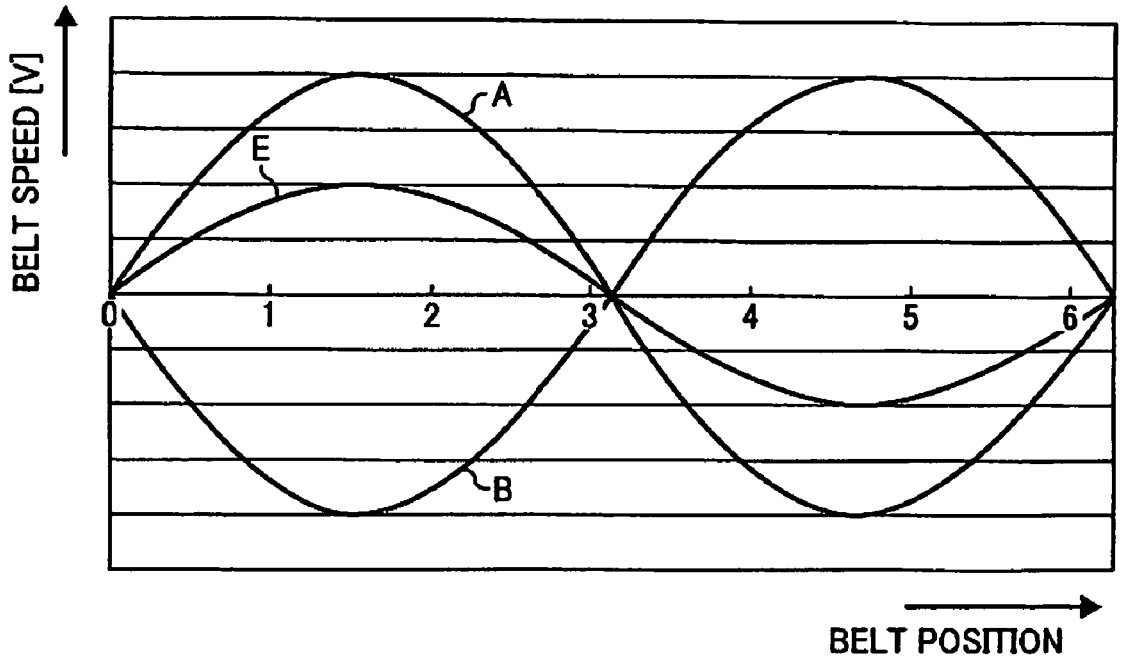
FIG. 10A is a graph illustrating a waveform A indicating a speed of the belt at each belt position when a roller is rotating at a constant angular velocity and a waveform B indicating the angular velocity of the roller at each belt position when the belt is rotating at a constant speed.

A relation between the angular velocity $\omega$ of a roller and the speed $V_b$ of the belt in a variation of the effective belt thickness $B_t$ of the intermediate transfer belt 8 is explained with reference to FIGS. 10A and 10B. In FIG. 10A, a waveform A indicates the speed $V_b$ of the belt at each belt position when the roller is rotating with the angular velocity $\omega$ being constant and a waveform B indicates the angular velocity $\omega$ of the roller at each belt position when the belt is rotating with the speed $V_b$ being constant. Furthermore, a waveform E indicates the effective belt thickness $B_t$. As is apparent from the waveform A, when the roller is rotating with the angular velocity $\omega$ being constant, the speed $V_b$ of the belt becomes the maximum at a point where the effective belt thickness $B_t$ of the belt is the maximum, and the speed $V_b$ of the belt becomes the minimum at a point where the effective belt thickness $B_t$ of the belt is the minimum. As is apparent from the waveform B, when the belt speed is $V_b$ is constant, the angular velocity $\omega$ of the roller becomes the minimum at a point where the effective belt thickness $B_t$ is the maximum, and the angular velocity $\omega$ becomes the maximum at a point where the effective belt thickness $B_t$ is the minimum. Such a relation is observed due to a correlation of $V_b=B_t\times\omega$ that is established among the angular velocity $\omega$, the belt speed $V_b$, and the effective belt thickness $B_t$. The correlation mentioned earlier can be understood from Equation (3) and Equation (5).

The following conclusions can be drawn from a result shown in FIG. 10A. When the driving roller 12 is rotated at the constant angular speed, the speed of the belt varies as indicated by the waveform A shown in FIG. 10A due to influence of the thickness of the belt. The angular velocity of the encoder roller 14 is affected by the speed variation mentioned earlier. If influence of the thickness variation is not taken into account, a waveform of the angular velocity of the encoder roller 14 becomes similar to the waveform of the speed variation mentioned earlier. However, actually, a variation component indicated by the waveform B shown in FIG. 10A is added to the angular velocity of the encoder roller 14 due to influence of thickness of the belt. In other words, a resulting waveform of the angular velocity of the encoder roller 14 becomes a superimposed waveform of the waveform A and the waveform B in FIG. 10A.

Figure 10B:
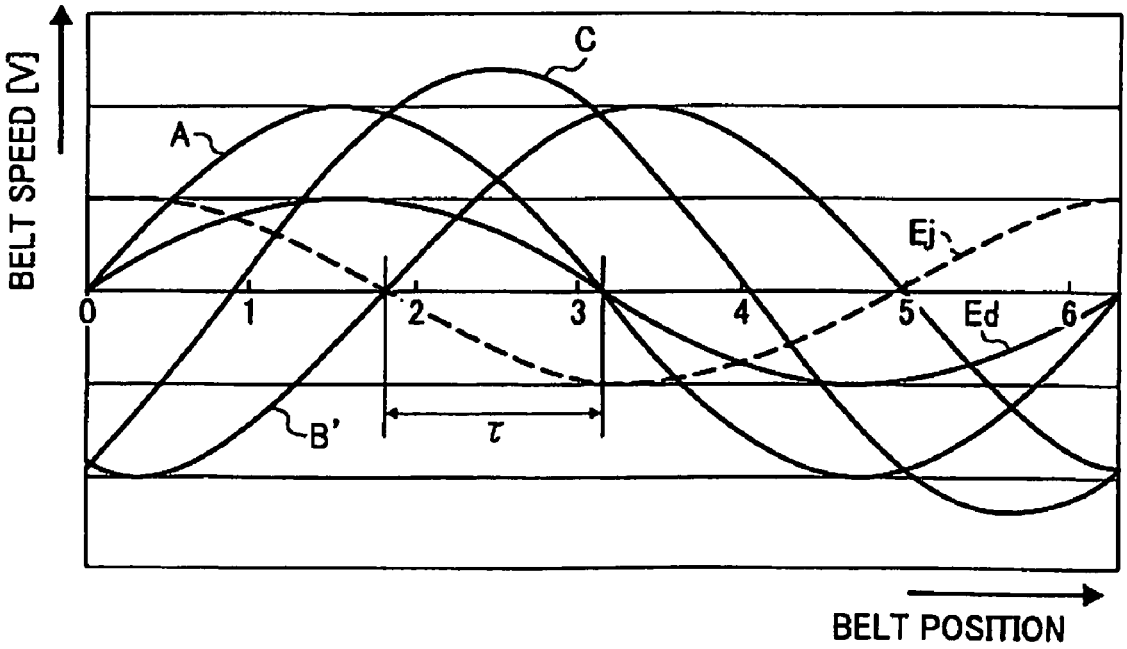
FIG. 10B is a graph illustrating a relation between a speed of a driving roller and a speed of the intermediate transfer belt with respect to a thickness variation of the intermediate transfer belt, and a relation between a speed of the encoder roller and the speed of the intermediate transfer belt with respect to the thickness variation of the intermediate transfer belt when the encoder roller and the driving roller are separated by a distance $\tau$ that is shown in FIG. 8.

FIG. 10B is a graph illustrating a relation between the speed of the driving roller 12 and the speed of the intermediate transfer belt 8 with respect to the thickness variation of the intermediate transfer belt 8, and a relation between the speed of the encoder roller 14 and the speed of the intermediate transfer belt 8 with respect to the thickness variation of the intermediate transfer belt 8 when the encoder roller 14 and the driving roller 12 are separated by a distance $\tau$ as shown in FIG. 8. As shown in FIG. 10B, a waveform A indicates the belt transport speed when the driving roller 12 rotates at the constant angular velocity. A waveform C indicates the angular velocity of the encoder roller 14 when the driving roller 12 rotates at the constant angular velocity. A waveform B' indicates the angular velocity of the encoder roller 14 when the intermediate transfer belt 8 rotates at the constant belt transport speed. A waveform $E_j$ indicates effective belt thickness variation of the intermediate transfer belt 8 at a driven rotation position of the encoder roller 14. A waveform $E_d$ indicates the effective belt thickness variation of the intermediate transfer belt 8 at a driving rotation position of the driving roller 12.

As is apparent from the waveforms in FIG. 10B, the waveform C is a superimposed waveform of the graph B' and the waveform A. In the waveforms shown in FIG. 10B, $R_e$ is equal to $R_d$, $\kappa_e$ is equal to $\kappa_d$, $\alpha$ is equal to zero, and $\tau$ is equal to 1.3 radian.

Moreover, as is apparent from the waveforms in FIG. 10B, when detecting, using the encoder 170, the waveform C that indicates the angular velocity, if the phase difference $\tau$ is $\pi$ rad (or an odd multiple of $\pi$), the waveform B' becomes the same as the waveform A. Due to this, the amplitude of the waveform C that is a combined curve of the waveform B' and the waveform A becomes the maximum (in the example shown in FIG. 10B, the amplitude of the waveform C becomes twice the amplitude of the waveform A). In other words, if the distance between the driving roller 12 and the encoder roller 14 can be set to half of a cycle of the belt thickness variation, a detection sensitivity of the angular velocity of the encoder roller 14 becomes the maximum. Similarly, if the distance is nearly equal to $\pi$, because the waveform B' and the waveform A become nearly equal, the detection sensitivity increases. Thus, it is desirable to select the encoder roller 14 such that the distance between the encoder roller 14 that detects the angular velocity and the driving roller 12 on the intermediate transfer belt 8 is nearly equal to $\pi$ (the distance is the maximum when a belt cycle component is equal to the single belt cycle).

Although setting the phase difference $\tau$ to exactly half of a belt thickness variation cycle is difficult actually considering a belt transportation path, if the phase difference $\tau$ can be set to nearly half of the belt thickness variation cycle, the detection sensitivity is enhanced. If the overall belt thickness variation is greater than or equal to two cycles, the phase difference $\tau$, in the variation cycle, can be set exactly to $\pi$ or to an odd multiple of $\pi$, thus enabling to get a high detection sensitivity. Upon expressing the relation mentioned earlier in terms of a belt length, the phase difference $\tau$ becomes half of the belt length corresponding to a cycle $T_b$ of the belt thickness variation or an odd multiple of the belt length corresponding to the cycle $T_b$ of the belt thickness variation.

In the present embodiment, the angular velocity of the driving roller 12 is adjusted such that the variation of the angular velocity of the encoder roller 14 becomes the angular velocity shown by the waveform B'. Specifically, the waveform B' is calculated from the waveform C shown in FIG. 10B. Both the waveform C and the waveform B' have the same cycle that is the cycle of the belt thickness variation. If the waveform C is K $\sin(\theta+\tau)$, the waveform B' can be expressed as $\eta K \sin(\theta+\tau+T)$. Thus, if a correction coefficient $\eta$ of the amplitude and a phase correction value T are known, the waveform B' can be calculated from the waveform C.

In a method that is explained below, the angular velocity (waveform B') of the encoder roller 14, when the intermediate transfer belt 8 is rotated at the constant belt transport speed, is calculated from the angular velocity (waveform C) of the encoder roller 14 when the driving roller 12 is driven at the constant angular speed.

First, the angular velocity $\omega_e$ of the encoder roller 14 can be expressed by the following Equation (6) from Equation (3) and Equation (5) mentioned earlier:

$$\omega_e = \frac{R_d + \kappa_d B_{t0} + \kappa_d B_{ta}\sin(\theta_b + \alpha)}{R_e + \kappa_e B_{t0} + \kappa_e B_{ta}\sin(\theta_b + \alpha + \tau)}\omega_d \tag{6}$$

The belt thickness variation $B_{ta}$ can be expressed by the following Equation (7) by approximating the belt thickness $B_{ta}$ as sufficiently smaller than a roller radius R.

$$\omega_e \cong \frac{R_d + \kappa_d B_{t0}}{R_e + \kappa_e B_{t0}}\left\{1 + \frac{\kappa_d B_{ta}}{R_d + \kappa_d B_{t0}}\sin(\theta_b + \alpha) - \frac{\kappa_e B_{ta}}{R_e + \kappa_e B_{t0}}\sin(\theta_b + \alpha + \tau)\right\}\omega_d \tag{7}$$

In the angular velocity $\omega_e$ of the encoder roller 14 that is indicated by Equation (7), a variation component $\Delta\omega_e$ can be expressed by the following Equation (8):

$$\Delta\omega_e \cong \frac{R_d + \kappa_d B_{t0}}{R_e + \kappa_e B_{t0}} B_{ta}\omega_d \left\{\frac{\kappa_d}{R_d + \kappa_d B_{t0}}\sin(\theta_b + \alpha) - \frac{\kappa_e}{R_e + \kappa_e B_{t0}}\sin(\theta_b + \alpha + \tau)\right\} \tag{8}$$

The variation component $\Delta\omega_e$ indicates the variation component due to the belt thickness variation of the single belt rotation. Among the two terms in the curly brackets in Equation (8), the first term A indicates a belt variation component at the belt driving position and the second term B indicates a belt variation component at the belt driven position. From the fractions outside the curly brackets, it is clearly understood that the detection sensitivity is enhanced by increasing the radius $R_d$ of the driving roller 12 than the radius $R_e$ of the encoder roller 14.

$$A = \frac{\kappa_d}{R_{d0} + \kappa_d B_{t0}}\sin(\theta_b + \alpha) \tag{9}$$

$$B = -\frac{\kappa_e}{R_{e0} + \kappa_e B_{t0}}\sin(\theta_b + \alpha + \tau) \tag{10}$$

If a data component that is detected by the encoder roller 14 when the driving roller 12 is rotated at the constant angular speed is treated as C, the data component C can be expressed by the following Equation (11):

$$C = A + B \tag{11}$$

Because both A and B are sine waves that include the same cycle, the sum of A and B is combined to a single sine wave of the same cycle. Due to this, the data component C can be expressed by a sine function. Thus, if K and $\beta$ are treated as constants, the data component C can be expressed by the following Equation (12):

$$C = K\sin(\theta b + \beta) \tag{12}$$

Figure 11:
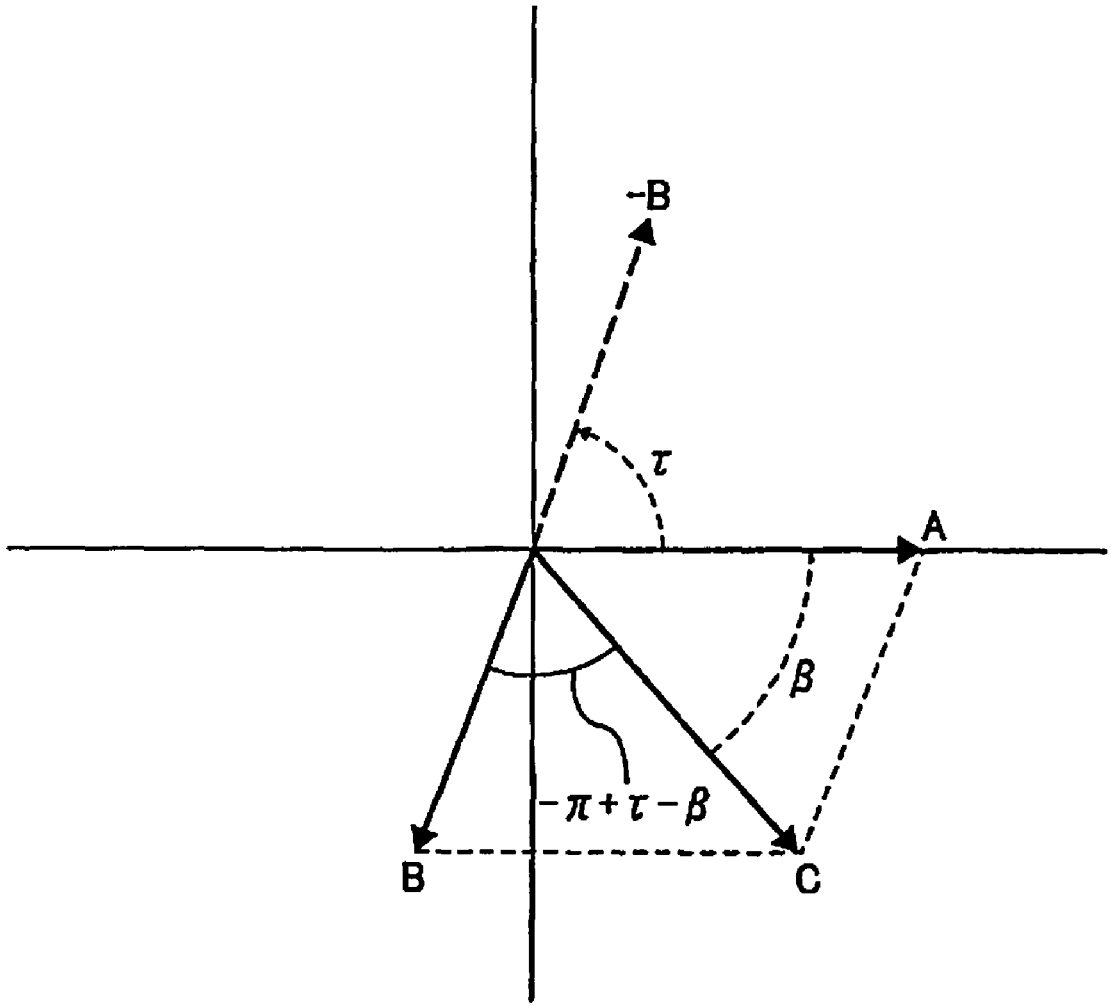
FIG. 11 is a schematic diagram of phase vector components of A, B, and C.

Because a rotation cycle of A, B, and C is the same as the rotation cycle of the intermediate transfer belt 8, A, B, and C can be expressed by phase vectors. FIG. 11 is a schematic diagram of phase vector components of A, B, and C. As shown in FIG. 11, a vector A is treated as zero degrees for generalization. However, an amplitude-phase relation of each vector is not affected even if the initial phase $\alpha$ is assigned to the vector A.

A conversion coefficient $\eta$, from an angular velocity variation (vector C) of the encoder roller 14 when the driving roller 12 is rotated at the constant speed, to a target value of an angular speed variation (vector B) of the encoder roller 14 at a constant belt speed, becomes the correction coefficient. Because both the vector B and the vector C are sine functions, multiplying the amplitude by the coefficient and carrying out a phase manipulation enables to carry out a conversion from the vector C to the vector B. In other words, as shown in FIG. 11, for converting from a vector component of the detected vector C to a vector component of the vector B, a length (amplitude) of the vector is converted into the correction coefficient $\eta$ and a phase is caused to be delayed by $\pi-\tau+\beta$. $\beta$ indicates a phase difference between A and C.

$$K = \sqrt{\left(\frac{\kappa_d}{R_d+\kappa_d B_{t0}}\right)^2+\left(\frac{\kappa_e}{R_e+\kappa_e B_{t0}}\right)^2-2\frac{\kappa_d\kappa_e}{(R_d+\kappa_d B_{t0})(R_e+\kappa_e B_{t0})}\cos\tau} \tag{13}$$

$$\beta = \tan^{-1}\left(\frac{-\frac{\kappa_e}{R_e+\kappa_e B_{t0}}\sin\tau}{\frac{\kappa_d}{R_d+\kappa_d B_{t0}}-\frac{\kappa_e}{R_e+\kappa_e B_{t0}}\cos\tau}\right) \tag{14}$$

The correction coefficient $\eta$ that converts variable amplitude detected at a driven roller side when the driving roller 12 is rotated at a constant speed into variable amplitude at the driven roller side when the intermediate transfer belt 8 is transported at the constant speed, can be expressed by the following Equation (15).

$$\eta = \frac{\kappa_e}{R_e+\kappa_e B_{t0}}\frac{1}{K} \tag{15}$$

Furthermore, the phase correction value T can be calculated by the following Equation (16).

$$T=-\pi+\tau-\beta \tag{16}$$

In other words, the amplitude, obtained as a result of multiplying by the correction coefficient $\eta$ and adding the phase correction value T, becomes variation data (the waveform B' shown in FIG. 10B) of the angular velocity of the encoder roller 14 when the intermediate transfer belt 8 is rotated at the constant speed with respect to the variable amplitude and the phase value of the speed variation pattern (the waveform C shown in FIG. 10B) of the single belt cycle that is detected by rotating the driving roller 12 at the constant speed. The variation data becomes the driving speed control pattern of the belt driving motor 162 for endlessly moving the intermediate transfer belt 8 at the constant speed corresponding to the belt thickness variation. Equations (13) to (15) are calculated by using values such as the roller radius and the phase difference that are all related to the structure of the belt driving unit. Due to this, the correction coefficient $\eta$ and the phase correction value T of the amplitude are constants that are determined in advance. However, the effective belt thickness coefficient $\kappa$ changes according to a material of the belt and the belt winding angle. Thus, the effective belt thickness coefficient $\kappa$ on the driving roller 12 side and on the encoder roller 14 side needs to be determined beforehand. The effective belt thickness coefficient $\kappa$ can be calculated by measuring a relation between an average speed of the belt and an average angular velocity of each roller. If the belt material and the belt winding angle are common to all devices, the effective belt thickness coefficient $\kappa$ can be measured for one device and the same value can be used for the remaining devices. Furthermore, using the driving roller 12 and the encoder roller 14 of the same radius R and the same effective belt thickness coefficient $\kappa$ enables to simplify Equations (13) and (14). Thus, it is desirable to design the belt transportation path to ensure that the respective belt winding angles are matching and the respective effective belt thickness coefficient $\kappa$ on the driving side and the driven side becomes nearly the same. Furthermore, it is experimentally ascertained that if the belt winding angle exceeds a specific angle, in other words, if sufficient belt winding angles are included on the driving roller 12 side and the encoder roller 14 side, the effective belt thickness coefficient $\kappa$ stabilizes, regardless of the belt winding angle, to a value that is specific to the belt structure. Thus, by having sufficient belt winding angles on the driving side and the driven side, ratio of the respective effective belt thickness coefficient $\kappa$ can be ensured to be one.

In the calculations explained earlier, the angular velocity of the driving roller 12 is treated as constant for easier understanding. However, the angular velocity of the driving roller 12 need not be constant due to a reason that is explained below. In calculations that are explained below, the angular speed of the driving roller 12 is caused to vary and the belt speed is treated as constant for easier understanding. Upon assuming that the belt speed is constant, the angular velocity of the driving roller 12 becomes equivalent to a waveform that is displaced by $\pi$ from the waveform A shown in FIG. 10B. The angular velocity of the encoder roller 14 becomes equivalent to the waveform B' shown in FIG. 10B. The difference between the angular velocity of the driving roller 12 (the waveform that is displaced by $\pi$ from the waveform A) and the angular velocity of the encoder roller 14 (the waveform B') becomes equivalent to the waveform C (the angular velocity of the encoder roller 14 when the driving roller 12 is rotated at constant speed) shown in FIG. 10B. Although the belt speed is assumed to be constant for easier understanding, if the angular velocity of the encoder roller 14 is subtracted from the angular velocity of the driving roller 12, the waveform C shown in FIG. 10B (the angular velocity of the encoder roller 14 when the driving roller 12 is rotated at constant speed) is obtained. This is because the relation between the variation components due to the belt thickness variation that is detected at a driven shaft side and that is expressed in Equations (9), (10), and (12) does not depend on the angular velocity of the driving roller 12. In other words, even if the angular velocity of a driving roller shaft is varying, subtracting the angular velocity of the driving roller shaft from the angular velocity of an encoder roller shaft enables to obtain the variation component due to the belt thickness variation similarly to when the driving roller shaft is rotated at constant speed.

Thus, based on the angular velocity of the encoder roller shaft and data that is obtained by measuring the variation of the angular velocity (angular displacement) of the driving roller shaft, a variation of the angular velocity (angular displacement), in other words, the speed variation pattern, of the encoder roller 14 due to the belt thickness variation in the single belt cycle is analyzed. Next, based on analysis data, the driving speed control pattern that enables to drive the intermediate transfer belt 8 at constant speed is calculated and data in the RAM 203 is updated. Updating the data in the RAM 203 enables to control a cyclic variation of the intermediate transfer belt 8 such as a belt speed variation due to a rotation variation of a driving system such as decentering of the driving roller 12, a belt speed variation due to the belt thickness variation, a belt speed variation due to thermal expansion of the belt and the rollers, and a belt speed variation due to slip.

The principle mentioned earlier, in which the variation component is approximated as a trigonometric function and expanded, can be applied to any structure regardless of a roller radius or a belt perimeter.

In the principle that is explained earlier, the angular velocity of the driving roller 12 and the angular velocity of the encoder roller 14 are used to control the cyclic variation of the intermediate transfer belt 8. However, because the angular displacement is obtained by integrating the angular speed, a similar principle can be applied using a rotation angular displacement (position) instead of the angular speed. When using the rotation angular displacement, a sine function in the equations is converted into a cosine function, the amplitude changes, and a steady state deviation occurs. However, a relation between the amplitudes and the phases of the waveforms A, B, and C is the significant aspect of the principle that is mentioned earlier and the relation between the amplitudes and the phases of the waveforms A, B, and C does not change regardless of whether the angular speed or the angular displacement is used. In other words, the correction coefficient $\eta$ of the amplitude and the phase correction value T, which are expressed by using similar equations to those mentioned earlier, can be calculated even if the waveforms A, B, and C indicate the angular displacement.

In the principle explained earlier, the variation is approximated as a sine wave when a basic wave component of the single belt cycle is dominant in a belt cyclic variation, and based on the amplitude and the phase of the sine wave, target standard signals of the single belt rotation are calculated as a sine wave. However, in actuality, approximating the cyclic variation of the used belt as a basic wave results in a significant error. To overcome the drawback, the belt cyclic variation can be approximated by using a second harmonic component that includes a half cycle of the basic wave, or an nth harmonic component that includes 1/n-th cycle of the basic wave. Such a method is similar to subjecting a periodic function to Fourier series expansion. A similar amplitude correction and phase correction can be carried out on the respective harmonic component. However, the phase difference $\tau$ needs to be converted according to a cycle of the respective harmonic component.

The home position sensor 160 shown in FIG. 3 detects timing after every lapse of a single belt cycle. Specifically, the intermediate transfer belt 8 used in the present embodiment includes a home position mark at a predetermined position in the circumferential direction. The home position sensor 160 that is arranged at a predetermined position outside the belt loop detects the home position mark for every single belt rotation.

As shown in FIG. 3, an image-data input unit (not shown) as an image data obtaining unit is connected to the I/O I/F 204 for obtaining image data that is transmitted from an external personal computer. Based on the image data, the controller 200 and the optical-writing control circuit 205 drive the optical writing unit 7, the processing units 6Y, 6M, 6C, and 6K, and the transfer unit 15 to form an image.

In the printer having the basic structure mentioned earlier, the processing units 6Y, 6M, 6C, and 6K and the optical writing unit 7 function as the image forming units that form the Y, M, C, and K toner images on the respective photosensitive elements 1Y, 1M, 1C, and 1K. The transfer unit 15 transfers the toner images that are carried by the respective photosensitive elements 1Y, 1M, 1C, and 1K onto the intermediate transfer belt 8 that moves endlessly along with rotatable driving of the driving roller 12, in a superimposed manner.

A structure that is a feature of the printer according to the present embodiment is explained next.

In the printer according to the present embodiment, a power-on standby mode, an image-formation-command standby mode, and a sleeping mode are included as modes during which an action from an operator is awaited. Turning on the power of the printer by the operator is awaited in the power-on standby mode. In the image-formation-command standby mode, an image formation command (print command) from the operator is awaited when the power is on and a later explained fixing-temperature maintaining process is being executed. Although an image forming operation is not carried out in the image-formation-command standby mode, the fixing-temperature maintaining process for maintaining the surface temperature of the fixing roller 20*a* near the fixing temperature is subsequently executed. In the sleeping mode, the image formation command from the operator is awaited when the power is on and the fixing-temperature maintaining process is not being executed. After completion of the image forming operation, the printer is in the image-formation-command standby mode for a while. However, if a time period during which the image formation command is not received exceeds a predetermined time period, the fixing-temperature maintaining process is stopped and the printer enters the sleeping mode from the image-formation-command standby mode.

If the power is turned on in the power-on standby mode, a post-power-on preparation process is necessitated for initializing and activating various components inside the printer. Furthermore, if the image formation command is issued in the sleeping mode, a post-sleeping preparation process is necessitated for activating the various components inside the printer according to requirements.

Figure 12:
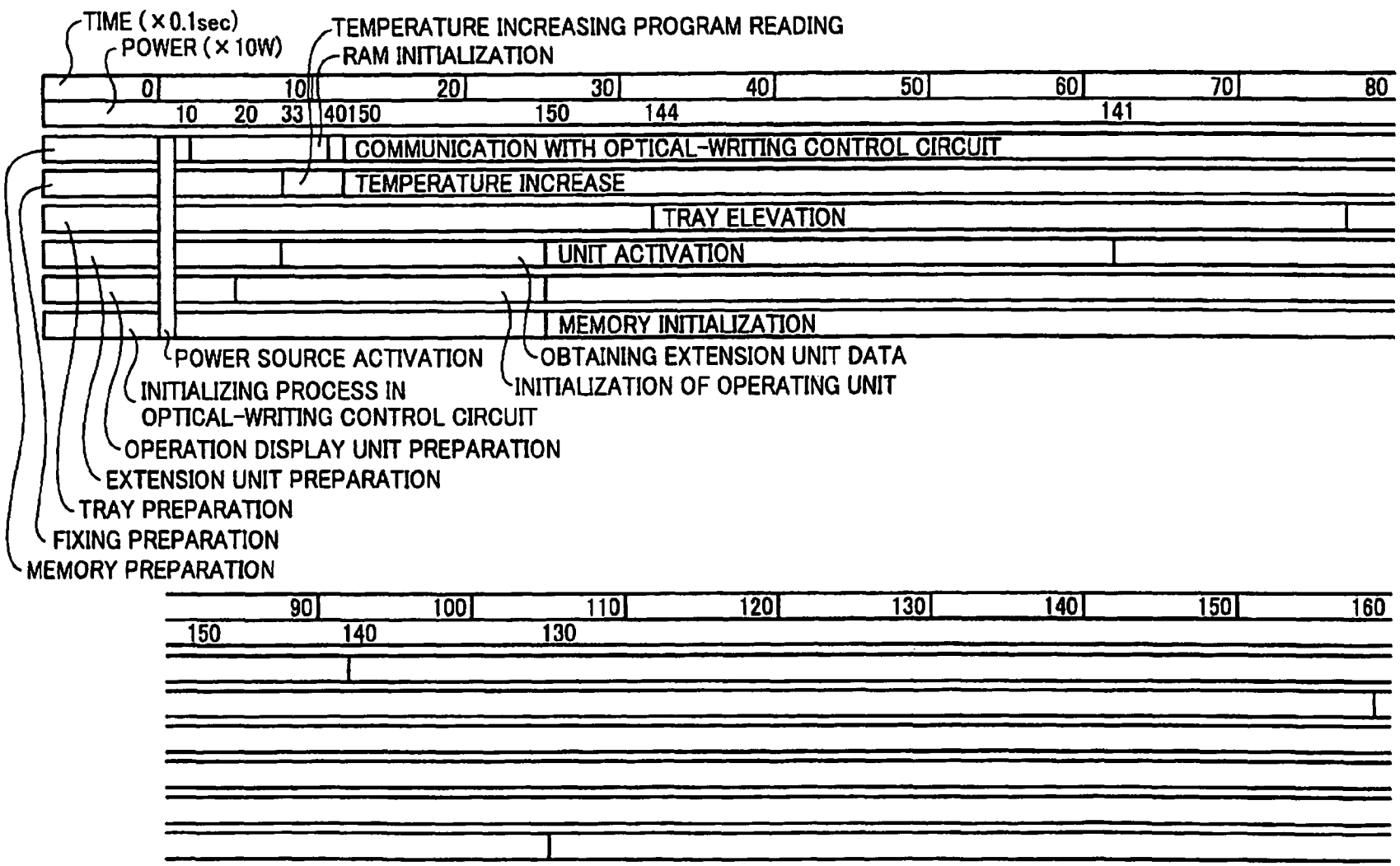

FIG. 12 is a timing chart of an example of execution timings of various processes in the post-power-on preparation process that is executed immediately after the power of the printer has been turned on. The execution timings indicated in the example shown in FIG. 12 are the execution timings of the processes immediately after the power is turned on when the surface temperature of the fixing roller 20*a* of the fixing unit 20 has dropped to the ambient temperature (25° C.). As shown in FIG. 12, in the post-power-on preparation process, the controller 200 of the printer executes a memory preparation process, a fixing preparation process, a tray preparation process, an extension-unit preparation process, and an operation-display-unit preparation process.

In the memory preparation process, after initializing the RAM 203 of the controller 200, a communication is carried out for initializing an image-data storing memory of the optical-writing control circuit 205. Due to this, the image-data storing memory that can store therein the image data of a large capacity is initialized.

In the fixing preparation process, after reading a temperature increasing program for maintaining the surface temperature of the fixing roller 20*a* to the predetermined fixing temperature (for example, 140° C.), the fixing heater 20*d* is turned on to execute a temperature increasing process for increasing the surface temperature to the fixing temperature. After the temperature increasing process, the surface temperature is periodically sampled, and if the surface temperature has fallen below the fixing temperature by a predetermined margin, the fixing-temperature maintaining process is subsequently executed to turn on the fixing heater 20*d*. However, the fixing-temperature maintaining process is not included in the post-power-on preparation process.

In the extension-unit preparation process, an extension-unit-data obtaining process is executed for confirming whether predetermined extension units such as a scanner (not shown) and an extension sheet feeding bank (not shown) are connected to the printer. If the extension units are connected to the printer, an activating process of the extension units is executed according to requirements such as moving a movement operating unit of the scanner to the home position or elevating a tray of the extension sheet feeding bank.

In the tray preparation process, a process is executed to elevate the tray inside the sheet feeding cassette 26 from the lowest position to a position where the sheet feeding cassette 26 strikes the sheet feeding roller 27. In the operation-display-unit preparation process, a memory of an operation display unit is initialized.

If the power is turned on when the fixing temperature has fallen by a certain margin, the fixing preparation process necessitates the longest time period among the various processes in the post-power-on preparation process. For example, if the fixing temperature has fallen to approximately 25° C., the fixing preparation process necessitates approximately 15 seconds.

In the printer according to the present embodiment, the driving-speed-control-pattern updating process is executed at the predetermined timing. When executing the driving-speed-control-pattern updating process, causing the intermediate transfer belt 8 to complete at least one rotation and updating the driving speed control pattern necessitates approximately 8 seconds. Accordingly, depending on the temperature of the fixing roller 20*a*, the time period required for the driving-speed-control-pattern updating process becomes less than the time period that is required for the post-power-on preparation process. The post-power-on preparation process is necessary regardless of whether the driving-speed-control-pattern updating process is executed and the driving-speed-control-pattern updating process can also be parallely executed during a time period (during a preparation time period) when the post-power-on preparation process is being executed. Due to this, the controller 200, which is a driving control device of the printer according to the present embodiment, executes the driving-speed-control-pattern updating process according to requirement when the post-power-on preparation process is being executed.

An initializing process in the optical-writing control circuit 205 shown in FIG. 12 is completed after approximately 9 seconds after the power has been turned on. Thus, the time period required for completion of the initializing process is longer than the time period (approximately 8 seconds) that is required for the driving-speed-control-pattern updating process. However, a process, which necessitates temporary storage of data, cannot be started until a lapse of approximately one second after the power has been turned on. Due to this, if the driving-speed-control-pattern updating process is unconditionally executed during the post-power-on preparation process, the driving-speed-control-pattern updating process is completed only after completion of the initializing process in the optical-writing control circuit 205.

Figure 13:
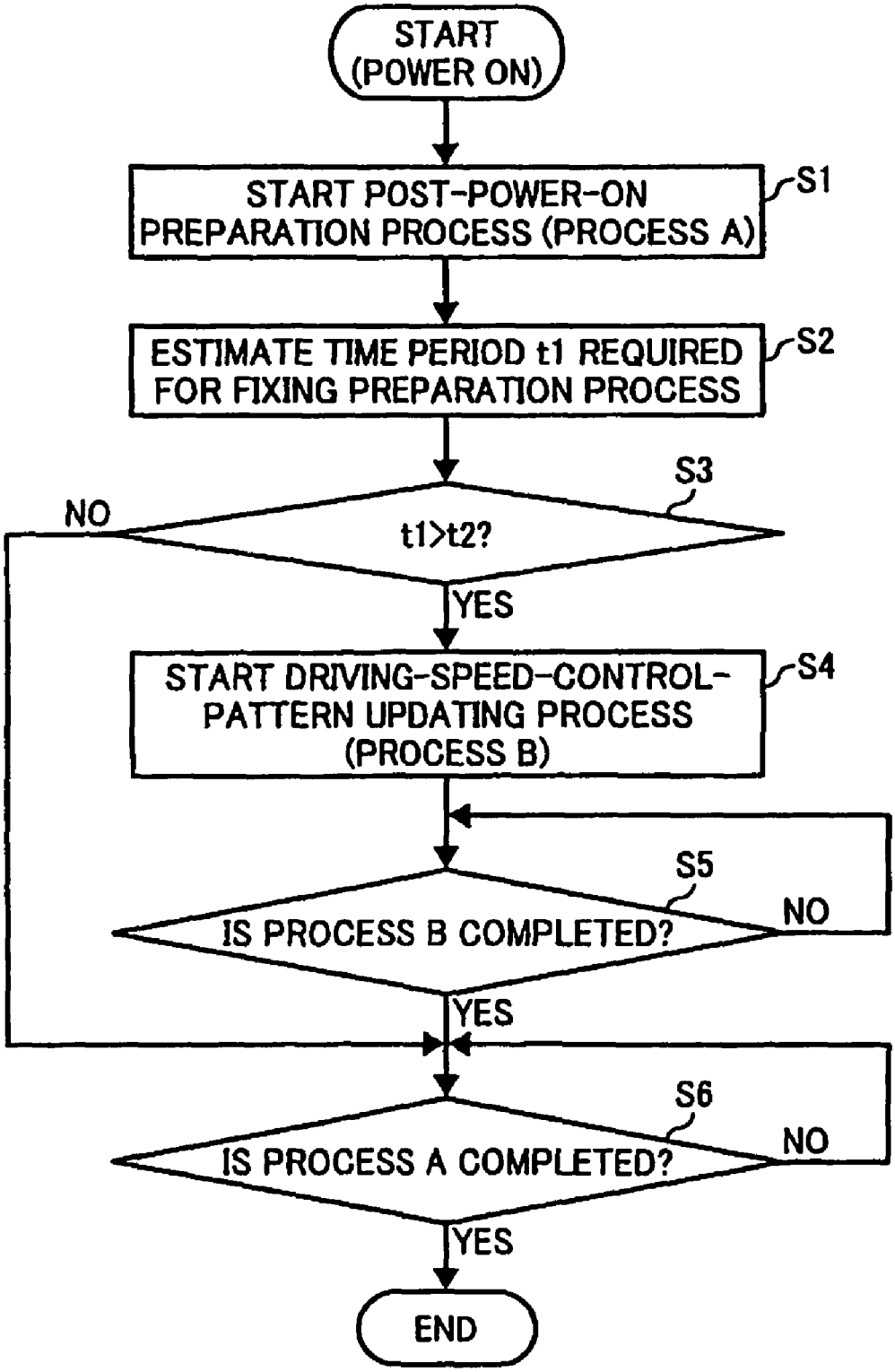

FIG. 13 is a flowchart of a control process that is executed by the controller 200 immediately after the power has been turned on. After the power of the printer is turned on, the controller 200 starts the post-power-on preparation process (Step S1) and estimates a time period t1 that is required for the fixing preparation process (Step S2). Specifically, the controller 200 stores in the ROM 202, a data table that indicates a relation between the surface temperature of the fixing roller 20*a* and a temperature increasing time period that is required to increase the surface temperature to the fixing temperature. The data table is obtained from experiments in advance. During a short time period from turning on the power until start of the fixing preparation process, the controller 200 obtains the surface temperature of the fixing roller 20*a* based on an output from the surface temperature sensor 20*c*. Next, based on the obtained surface temperature and the data table, the controller 200 estimates the time period t1 that is required for the fixing preparation process.

Upon estimating the time period t1 that is required for the fixing preparation process, the controller 200 determines whether the time period t1 is greater than a time period t2 that is prior stored in the RAM 203 and that is required for the driving-speed-control-pattern updating process (Step S3). If the time period t1 is not greater than the time period t2 (NO at Step S3), the controller 200 completes the post-power-on preparation process (YES at Step S7), and after completing a string of the process flow, causes the printer to enter the image-formation-command standby mode.

If the time period t1 is greater than the time period t2 (YES at Step S3), the controller 200 starts the driving-speed-control-pattern updating process (Step S4). Upon completion of the driving-speed-control-pattern updating process (Step S5), the controller 200 determines whether the post-power-on preparation process is completed (Step S6). If the post-power-on preparation process is completed, the controller 200 completes a string of the process flow and causes the printer to enter the image-formation-command standby mode.

If the controller 200 determines at Step S3 that the time period t1 is not greater than the time-period t2, thus omitting the driving-speed-control-pattern updating process, driving of the belt driving motor 162 in the subsequent print job is controlled based on the driving speed control pattern that is stored in the RAM 203 before the power has been turned on. In other words, although updating of the driving speed control pattern is omitted, a resulting destabilization of a belt running speed is less likely to occur. If the time period t1 is greater than the time period t2, it is considered that the power is turned off when the fixing temperature is being appropriately maintained and the power is again turned on in a relatively short time period. Thus, the driving speed control pattern is less likely to be adversely affected due to environmental change.

In the printer that executes the control mentioned earlier, if the driving-speed-control-pattern updating process is highly likely to be successfully completed during execution of the post-power-on preparation process (during the preparation time period), the driving-speed-control-pattern updating process is executed during the preparation time period. Thus, an increase in a waiting time period of a user due to the driving-speed-control-pattern updating process can be nearly avoided.

Figure 14:
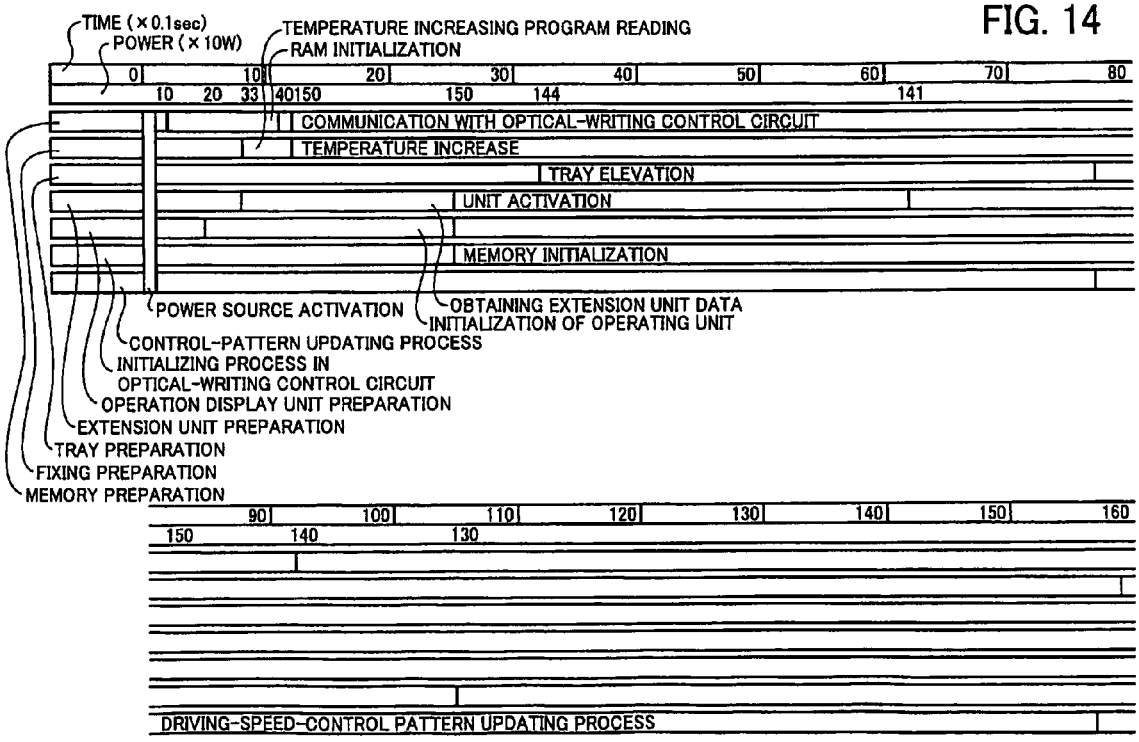
FIG. 14 is a timing chart of an example of the execution timings of the various processes in the post-power-on preparation process and a driving-speed-control-pattern updating process that are executed immediately after the power has been turned on when a surface temperature of a fixing roller has fallen to approximately the ambient temperature.

FIG. 14 is a timing chart of an example of the execution timings of the various processes in the post-power-on preparation process and the driving-speed-control-pattern updating process that are executed immediately after the power has been turned on when the surface temperature of the fixing roller 20*a* has fallen to approximately the ambient temperature. As shown in FIG. 14, if the power is turned on when the surface temperature of the fixing roller 20*a* has fallen to approximately the ambient temperature, the driving-speed-control pattern-updating process is completed during the time period when the post-power-on preparation process is being executed. In other words, the driving speed control pattern can be updated while avoiding an increase in the waiting time period of the user.

In the post-sleeping preparation process mentioned earlier, although several preparation processes in the post-power-on preparation process shown in FIG. 12 are omitted, the fixing preparation process is definitely executed. Depending on the surface temperature of the fixing roller 20*a*, similarly to the post-power-on preparation process, the driving-speed-control-pattern updating process is started and completed during the time period when the post-sleeping preparation process is being executed. Specifically, similarly to the post-power-on preparation process, when the post-sleeping preparation process is started, the controller 200 estimates the time period t1 that is required for the fixing preparation process, and if the time period t1 is greater than the time period t2, the controller 200 starts the driving-speed-control-pattern updating process. Due to this, even when executing the post-sleeping preparation process, the driving speed control pattern can be updated while avoiding an increase in the waiting time period of the user.

Apart from the post-power-on preparation process and the post-sleeping preparation process, the controller 200 of the printer according to the present embodiment also executes a pre-image-formation cleaning process if necessitated. Specifically, as shown in FIG. 1, a cover 60 is arranged on the housing of the printer. The cover 60 swings around a swinging shaft 63. When the cover 60 rotates clockwise by a predetermined angle around the swinging shaft 63, the sheet feeding path 70 and the pre-reversion conveying path 73 are significantly exposed to outside. Due to this, a sheet that is jammed in the sheet feeding path 70 and the pre-reversion conveying path 73 can be easily removed. When carrying out a jam process operation, if the user accidentally rubs a jammed sheet having the unfixed toner image on the intermediate transfer belt 8 that is exposed to the outside due to opening of the cover 60, the intermediate transfer belt 8 is soiled. When the print job is stopped upon occurrence of a jam, the unfixed toner image that is still not secondary transferred onto the recording sheet P is placed on the intermediate transfer belt 8. Therefore, after the user has carried out the jam process operation, before starting the next print job, the controller 200 executes the pre-image-formation cleaning process in which the controller 200 causes the belt cleaning unit 10 to clean the intermediate transfer belt 8 while causing the intermediate transfer belt 8 to complete at least one rotation.

Apart from after the jam process operation, the controller 200 also executes the pre-image-formation cleaning process in the following instances. In other words, in the printer according to the present embodiment, by marginally moving three of the four primary-transfer bias rollers 9Y, 9M, 9C, and 9K that are arranged on the inner side of the loop of the intermediate transfer belt 8, a support position of the intermediate transfer belt 8 can be changed. Specifically, image formation using the Y, M, and C colors is not necessary when carrying out monochromatic printing. Driving the Y, M, and C processing units 6Y, 6M, and 6C and causing the Y, M, and C photosensitive elements 1Y, 1M, and 1C to be in contact with the intermediate transfer belt 8, even when not necessitated, results in unnecessary power consumption and shortens the lifetime of the intermediate transfer belt 8 and the photosensitive elements 1Y, 1M, and 1C. To overcome the drawback, during monochromatic printing, the three primary-transfer bias rollers 9Y, 9M, and 9C are marginally moved away from the intermediate transfer belt 8, thus changing the support position of the intermediate transfer belt 8 and separating the intermediate transfer belt 8 from the photosensitive elements 1Y, 1M, and 1C. Upon receiving a color printing command when the intermediate transfer belt 8 is separated from the photosensitive elements 1Y, 1M, and 1C, the primary-transfer bias rollers 9Y, 9M, and 9C are moved towards the intermediate transfer belt 8 to come into contact with the intermediate transfer belt 8. When moving the primary-transfer bias rollers 9Y, 9M, and 9C, the Y, M, and C toner adhering to the surface of the photosensitive elements 1Y, 1M, and 1C respectively due to reaction may be transferred onto the intermediate transfer belt 8. Upon causing the intermediate transfer belt 8 to be in contact with the photosensitive elements 1Y, 1M, 1C, and 1K as a result of receiving the color printing command when the intermediate transfer belt 8 is separated from the photosensitive elements 1Y, 1M, 1C, and 1K, the controller 200 executes the pre-image-formation cleaning process before the color print job.

In the pre-image-formation cleaning process, because at least the intermediate transfer belt 8 is caused to rotate at least one rotation, the driving speed control pattern can be analyzed and updated. Due to this, the controller 200 executes the driving-speed-control-pattern updating process in parallel when the pre-image-formation cleaning process is being executed. Thus, an increase in the waiting time period of the user due to the driving-speed-control-pattern updating process can be avoided.

In the example of the printer explained earlier, the controller 200 completes the driving-speed-control-pattern updating process during the time period when the post-power-on preparation process and the post-sleeping preparation process are being executed. However, the driving-speed-control-pattern updating process need not always be completed during the time period when the preparation processes are being executed. The driving-speed-control-pattern updating process can be executed in parallel during a portion of the time period when the preparation processes are being executed and the driving-speed-control-pattern updating process can be completed after the time period of the preparation processes has ended. Thus, the waiting time period of the user can be reduced compared with when the driving-speed-control-pattern updating process is executed independently.

In the example of the printer explained earlier, the memory preparation process, the fixing preparation process, the tray preparation process, the extension-unit preparation process and the operation-display-unit preparation process are executed in the post-power-on preparation process and the post-sleeping preparation process. However, the present invention can be similarly applied to an image forming apparatus that executes only some of the processes mentioned earlier. The present invention can also be applied to an image forming apparatus that executes processes other than the processes mentioned earlier in the post-power-on preparation process and the post-sleeping preparation process. A process control process and a phase aligning process can be executed as one of the other preparation processes. In the process control process, toner images of predetermined grayscale patterns are formed on the surface of the belt member, and based on a result of detecting an image density of the toner images, the developing bias, amount of optical writing, and a target toner density of the developer are adjusted. The phase aligning process is carried out for curbing a displacement of the toner images during transfer of the tone images onto the belt member in a superimposed manner due to decentering of the photosensitive elements. In the phase aligning process, a rotational position of the photosensitive elements is adjusted for aligning phases of the speed variation of photosensitive element surfaces due to decentering.

Thus, in the printer according to the present embodiment, after the power of the printer has been turned on or after the operator has issued the image formation command, the controller 200 that functions as the driving control device estimates a length of the time period t1 that is the preparation time period required for the post-power-on preparation process and the post-sleeping preparation process. Based on the estimation result, the controller 200 determines whether to start the driving-speed-control-pattern updating process during the time period t1. The controller 200 executes the driving-speed-control-pattern updating process in parallel with the post-power-on preparation process and the post-sleeping preparation process only if the time period t1 is longer than the time period t2 that is necessitated for executing the driving-speed-control-pattern updating process. Due to this, an increase in the waiting time period of the user due to execution of the driving-speed-control-pattern updating process can be avoided.

In the printer according to the present embodiment, based on the estimation result of the time period t1, upon determining not to start the driving-speed-control-pattern updating process during the time period when the post-power-on preparation process and the post-sleeping preparation process are being executed (during the preparation time period), the controller 200 controls driving of the belt driving motor 162 (and consequently, the driving roller 12) based on the driving speed control pattern that is stored before the power has been turned on or before the image formation command has been issued. With this configuration, execution of the driving-speed-control-pattern updating process is omitted when the driving speed control pattern is less likely to be adversely affected due to environmental change. Thus, an increase in the waiting time period of the user due to unnecessarily executing the driving-speed-control-pattern updating process can be avoided.

In the printer according to the present embodiment, the controller 200 estimates whether the driving-speed-control-pattern updating process can be completed during the estimated time period t1. If the driving-speed-control-pattern updating process can be completed, the controller 200 starts the driving-speed-control-pattern updating process during the time period t1 (the preparation time period). Thus, the controller 200 executes the driving-speed-control-pattern updating process only if the driving-speed-control-pattern updating process can be completed during the time period (the preparation time period) when the post-power-on preparation process and the post-sleeping preparation process are being executed. Due to this, an increase in the waiting time period of the user due to execution of the driving-speed-control-pattern updating process can be avoided.

In the printer according to the present embodiment, the preparation processes include the fixing preparation process for increasing to the predetermined fixing temperature, the temperature of the fixing roller 20*a* of the fixing unit 20 that executes a fixing process of the toner images on the recording sheet P as a recording medium. With this configuration, all or part of the driving-speed-control-pattern updating process can be performed by utilizing a time period for execution of the fixing preparation process.

According to one aspect of the present invention, a time period necessitated for a driving-speed-control-pattern updating process is entirely or partially incorporated into a preparation time period in which an image forming apparatus is activated and image formation is enabled. The preparation time period, for example, indicates a time period in which the temperature of a fixing unit is increased to a predetermined fixing temperature, a component is moved to an operating position, or a component is driven idly for a predetermined time period due to some reason. The preparation time period is necessitated regardless of whether the driving-speed-control-pattern updating process is executed. Incorporating the driving-speed-control-pattern updating process entirely or partially into the preparation time period enables to curb an increase in a waiting time period of a user due to execution of the driving-speed-control-pattern updating process.

According to another aspect of the present invention, the driving-speed-control-pattern updating process is incorporated into a time period during which a pre-image-formation cleaning process is executed before start of image formation. Due to this, an increase in the waiting time period of the user due to execution of the driving-speed-control-pattern updating process can be curbed. The pre-image-formation cleaning process indicates cleaning a belt member to which toner might have adhered during a jam process, while causing the belt member to move endlessly for at least a single rotation after the user has executed the jam process to remove a recording sheet that is jammed into a conveying path.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A driving control device for use in an image forming apparatus that includes a plurality of image carriers on which toner images are formed, respectively, and a transfer unit that includes an endless belt member and a plurality of rotating units that support the endless belt member, where at least one of the plurality of rotating units is a driving rotating unit configured to rotate to move the endless belt member endlessly so that the toner images on the image carriers are transferred onto a surface of the endless belt member or a recording medium that is held on the surface, the driving control device comprising:

a control unit configured to analyze any one of a speed variation pattern and a thickness variation pattern of the endless belt member per at least one rotation of the endless belt member while endlessly moving the endless belt member, and configured to start to execute, based on a result of the analysis, a driving-speed-control-pattern updating process to update a driving speed control pattern of the driving rotating unit per at least one rotation of the endless belt member, after a power of the image forming apparatus is turned on and within a preparation period in which a preparation process is completed so that an image forming operation can be started based on an image formation command from an operator.

2. The driving control device according to claim 1, wherein the control unit is configured to estimate the preparation period after the power is turned on, and configured to determine, based on a result of estimation, whether to start the driving-speed-control-pattern updating process within the preparation period.

3. The driving control device according to claim 2, wherein upon determining, based on the result of estimation, not to start the driving-speed-control-pattern updating process within the preparation period, the control unit is configured to control, based on a driving speed control pattern that is stored therein before the power is turned on, driving of the driving rotating unit after the preparation period is elapsed.

4. The driving control device according to claim 2, wherein the control unit is configured to estimate whether the driving-speed-control-pattern updating process can be completed within estimated preparation period, and starts, upon determining that the driving-speed-control-pattern updating process can be completed, the driving-speed-control-pattern updating process.

5. The driving control device according to claim 1, wherein the preparation process includes a process to increase a temperature of a fixing unit that executes a fixing process for fixing the toner images onto the recording medium by heat to a threshold temperature.

6. An image forming apparatus comprising:

a plurality of image carriers on which toner images are formed, respectively;

a transfer unit that includes an endless belt member and a plurality of rotating units that supports the endless belt member, where at least one of the rotating units is a driving rotating unit configured to rotate to move the endless belt member endlessly so that the toner images on the image carriers are transferred onto a surface of the endless belt member or a recording medium that is held on the surface; and the driving control device according to claim 1.

7. A driving control device for use in an image forming apparatus that includes a plurality of image carriers on which toner images are formed, respectively, and a transfer unit that includes an endless belt member and a plurality of rotating units that support the endless belt member, where at least one of the rotating units is a driving rotating unit configured to rotate to move the endless belt member endlessly so that the toner images on the image carriers are transferred onto a surface of the endless belt member or a recording medium that is held on the surface, the driving control device comprising:

a control unit configured to analyze any one of a speed variation pattern and a thickness variation pattern of the endless belt member per at least one rotation of the endless belt member while endlessly moving the endless belt member, and configured to start to execute, based on a result of the analysis, a driving-speed-control-pattern updating process to update a driving speed control pattern of the driving rotating unit per at least one rotation of the endless belt member, after an image formation command from an operator is issued and within a preparation period in which a preparation process is completed so that an image forming operation can be started based on the image formation command.

8. The driving control device according to claim 7, wherein the control unit is configured to estimate, the preparation period after the image formation command is issued, and configured to determined, based on a result of estimation, whether to start the driving-speed-control-pattern updating process within the preparation period.

9. The driving control device according to claim 8, wherein upon determining, based on the result of estimation, not to start the driving-speed-control-pattern updating process within the preparation period, the control unit is configured to control, based on a driving speed control pattern that is stored therein before the image formation command is issued, driving of the driving rotating unit after the preparation period is elapsed.

10. The driving control device according to claim 8, wherein the control unit is configured to estimate whether the driving-speed-control-pattern updating process can be completed within estimated preparation period, and starts, upon determining that the driving-speed-control-pattern updating process can be completed, the driving-speed-control-pattern updating process.

11. The driving control device according to claim 7, wherein the preparation process includes a process to increase a temperature of a fixing unit that executes a fixing process for fixing the toner images onto the recording medium by heat to a threshold temperature.

12. An image forming apparatus comprising:

a plurality of image carriers on which toner images are formed, respectively;

a transfer unit that includes an endless belt member and a plurality of rotating units that support the endless belt member, where at least one of the rotating units is a driving rotating unit configured to rotate to move the endless belt member endlessly so that the toner images on the image carriers are transferred onto a surface of the endless belt member or a recording medium that is held on the surface; and the driving control device according to claim 7.

13. A driving control device for use in an image forming apparatus that includes a plurality of image carriers on which toner images are formed, respectively, and a transfer unit that includes an endless belt member and a plurality of rotating units that support the endless belt member, where at least one of the plurality of rotating units is a driving rotating unit configured to rotate to move the endless belt member endlessly so that the toner images on the image carriers are transferred onto a surface of the endless belt member or a recording medium that is held on the surface, the driving control device comprising:

a control unit configured to analyze any one of a speed variation pattern and a thickness variation pattern of the endless belt member per at least one rotation of the endless belt member while endlessly moving the endless belt member and configured to execute, based on a result of the analysis, a driving-speed-control-pattern updating process to update a driving speed control pattern of the driving rotating unit per at least one rotation of the endless belt member, and configured to execute, before starting an image forming operation based on an image formation command from an operator or before restarting the image forming operation that has been stopped, a pre-image-formation cleaning process by bringing a cleaning unit into contact with a front surface of the endless belt member while rotating the belt member at least once rotation to clean the front surface, wherein the driving-speed-control-pattern updating process is executed while the pre-image-formation cleaning process is being executed.

14. An image forming apparatus comprising:

a plurality of image carriers on which toner images are formed, respectively;

a transfer unit that includes an endless belt member and a plurality of rotating units that supports the endless belt member, where at least one of the rotating units is a driving rotating unit configured to rotate to move the endless belt member endlessly so that the toner images on the image carriers are transferred onto a surface of the endless belt member or a recording medium that is held on the surface; and the driving control device according to claim 13.

* * * * *

UNITED STATES PATENT AND TRADEMARK OFFICE

CERTIFICATE OF CORRECTION

PATENT NO. : 7,929,894 B2
APPLICATION NO. : 12/314514
DATED : April 19, 2011
INVENTOR(S) : Takuya Murata et al.

It is certified that error appears in the above-identified patent and that said Letters Patent is hereby corrected as shown below:

Title Page, please insert Item (30):

-- (30) Foreign Application Priority Data

Dec. 12, 2007 (JP) ..... 2007-320614 --.

Signed and Sealed this
Twenty-third Day of August, 2011

David J. Kappos

David J. Kappos
*Director of the United States Patent and Trademark Office*